US007419154B2

(12) United States Patent
Pelletier et al.

(10) Patent No.: US 7,419,154 B2
(45) Date of Patent: Sep. 2, 2008

(54) FEEDER DEVICE HAVING ADJUSTABLY FLEXIBLE GATE APPARATUS AND ASSOCIATED METHOD

(75) Inventors: Joël Pelletier, Saint Sylvain d'Anjou (FR); Sylvain Zumbiehl, Cugand (FR); Olivier Boisdon, Saint-Léger-des-Bois (FR)

(73) Assignee: ZIH Corporation, Hamilton (BM)

( * ) Notice: Subject to any disclaimer, the term of this patent is extended or adjusted under 35 U.S.C. 154(b) by 67 days.

(21) Appl. No.: 10/837,905

(22) Filed: May 3, 2004

(65) Prior Publication Data

US 2005/0242488 A1 Nov. 3, 2005

(51) Int. Cl.
*B65H 3/52* (2006.01)

(52) U.S. Cl. ..... 271/124; 271/137; 271/121

(58) Field of Classification Search ..... 271/124, 271/121, 137, 167, 110, 160
See application file for complete search history.

(56) References Cited

U.S. PATENT DOCUMENTS

| | | | | |
|---|---|---|---|---|
| RE15,293 | E | 2/1922 | La Bombard | |
| 1,637,833 | A | 9/1927 | Mueller | |
| 1,940,487 | A | 12/1933 | Campbell | |
| 2,726,862 | A * | 12/1955 | Anderson | 271/124 |
| 3,705,719 | A | 12/1972 | Polit et al. | |
| 3,847,382 | A | 11/1974 | McKee | |
| 3,891,203 | A | 6/1975 | Schiff | |
| 3,908,983 | A | 9/1975 | Long | |
| 3,948,506 | A * | 4/1976 | Crimmins et al. | 271/165 |
| 4,081,181 | A | 3/1978 | Crowe et al. | |
| 4,222,313 | A | 9/1980 | Staufer | |
| 4,330,155 | A | 5/1982 | Richardson et al. | |
| 4,478,399 | A | 10/1984 | Morin et al. | |
| 4,568,074 | A | 2/1986 | Murayoshi | |
| 4,653,743 | A * | 3/1987 | Ebata et al. | 271/124 |
| 4,934,685 | A | 6/1990 | Shifley | |
| 4,961,566 | A | 10/1990 | Labombarde | |
| 4,978,115 | A | 12/1990 | Sato et al. | |
| 5,409,205 | A | 4/1995 | Macke, Sr. et al. | |
| 5,549,200 | A | 8/1996 | Cowan et al. | |
| 5,549,290 | A | 8/1996 | Long et al. | |
| 5,601,282 | A | 2/1997 | Milo et al. | |
| 5,769,408 | A | 6/1998 | Selak et al. | |

(Continued)

FOREIGN PATENT DOCUMENTS

| | | |
|---|---|---|
| DE | 23 20 319 A1 | 12/1973 |

(Continued)

*Primary Examiner*—Kaitlin S Joerger
(74) *Attorney, Agent, or Firm*—Alston & Bird LLP

(57) ABSTRACT

A feeder device for feeding a unit of media from a stack of media to a receiving apparatus is provided. The feeder device comprises a drive mechanism for driving the media in a feed direction through an opening defined by a gate apparatus. The opening extends from a first to a second edge of the gate apparatus and defines a fixed height greater than the thickness of the media. A flexible blade member is fixedly engaged with the gate apparatus at a fixed end and is cantilevered with respect to the gate apparatus. The blade member defines a length and extends from the first edge toward the second edge to reduce the opening height. The blade member is further configured to have an adjustable flexibility to allow the feeder device to feed media of varying thickness to the printing apparatus. An associated method is also provided.

26 Claims, 14 Drawing Sheets

U.S. PATENT DOCUMENTS

| | | | | |
|---|---|---|---|---|
| 5,772,199 | A | 6/1998 | Green | |
| 5,906,366 | A | 5/1999 | Chang | |
| 6,050,562 | A | 4/2000 | Long | |
| 6,315,283 | B1 | 11/2001 | Haas et al. | |
| 6,431,540 | B1 | 8/2002 | Lien et al. | |
| 6,457,886 | B1 | 10/2002 | Meier | |
| 6,536,758 | B2 | 3/2003 | Meier et al. | |
| 6,758,470 | B1 * | 7/2004 | Meier et al. | 271/124 |
| 2002/0059880 | A1 | 5/2002 | Klinefelter et al. | |
| 2002/0105135 | A1 | 8/2002 | Meier et al. | |
| 2003/0024422 | A1 | 2/2003 | Pribula et al. | |
| 2003/0152409 | A1 | 8/2003 | Pribula et al. | |

FOREIGN PATENT DOCUMENTS

| | | | |
|---|---|---|---|
| FR | 814 259 | A | 6/1937 |
| GB | 400 816 | A | 11/1933 |
| GB | 2 083 447 | A | 3/1982 |

* cited by examiner

FEEDER DEVICE HAVING ADJUSTABLY FLEXIBLE GATE APPARATUS AND ASSOCIATED METHOD

BACKGROUND OF THE INVENTION

1. Field of the Invention

The present invention relates to a feeder device for a receiving apparatus and, more particularly, to a feeder device for feeding a medium to a device, the feeder device having an adjustably flexible feed gate apparatus, and associated method.

2. Description of Related Art

A printer device such as, for example, a printer as described herein, typically includes a feeder for supplying media, such as individual cards, to the printer, a print engine which includes a transport mechanism for transporting the card through the printer and a printing mechanism for printing on the individual cards, and an exit or output hopper for receiving the printed cards. Further, the feeder generally comprises a card hopper for receiving the stack of cards to be fed, in addition to a drive mechanism for feeding the cards to the print engine. A gate at the exit of the feeder, otherwise known as the outlet opening, can include a separation mechanism for separating individual cards, usually an end card, from the stack in order to feed only one card to the print engine at each feed cycle.

Such a card feeder may be used on other card processing systems, such as a patch lamination system, a magnetic card or smart card encoding system, or the like. The drive system generates the driving force for the end card and the separation mechanism generates a separation force on the stack so as to allow the end card to be separated therefrom. With such a card feeder system, a general intent is to provide a driving force on the end card that is greater than the separation force imparted on the stack under many conditions that can exist in the card feeder. The separation force exerted by the separation mechanism on the stack typically has to be greater than a sticking force that can exist between the end card and the remainder of the cards in the stack. This sticking force may be related to, for example, electrostatic discharge ("ESD") between cards, cut or folded card edges, the weight of the stack on the end card, the thickness of the cards in the stack, or other factors or combinations thereof.

In order to address these concerns in a card feeder, a compromise often must be achieved between the separator mechanism, which exerts the separating force on the stack that must be greater than the sticking force between the stack and the end card, and the drive system, which must provide a driving force greater than the separating force, regardless of the type, thickness, condition, and quantity of the cards in the stack. As such, early card feeder devices implemented a fixed gate having a fixed dimension outlet opening generally corresponding to the thickness of a single card. However, such a configuration is generally effective only for the particular card thickness, and that effectiveness may be limited in instances of, for example, card thickness variation within the stack, or warped cards.

One further development was to provide a gate allowing for height adjustment of the outlet opening in correspondence with the thickness of the card to be fed. In such instances, the gate was provided with a movable blade, such as a cam-operated movable blade. However, the effectiveness of the movable blade configuration was also limited in instances of, for example, card thickness variation within the stack, or warped cards.

Other instances of such a card feeder include a flexible blade affixed to the gate so as to allow the outlet opening to vary in dimension to better accommodate the thickness of the card being fed. The flexible blade more readily accommodates card thickness variations within the stack or warped cards. However, the flexible blade may often be optimized for a particular card thickness or a narrow range of card thicknesses, and thus may not be applicable or effective for different card thicknesses or card thicknesses outside the optimal thickness range.

A further example of a card feeder is disclosed in U.S. Pat. No. 6,536,758 to Meier et al. The Meier '758 patent describes a feeder having movable gate with a flexible blade, wherein the gate/blade assembly is adjustable to accommodate various card thicknesses. That is, the cards are fed through an outlet opening in a hopper wall and the flexible blade reduces a height of the outlet opening to less than the thickness of the end card. As a card is passed through the outlet opening, the card contacts the flexible blade and the blade flexes in response. The control gate is movable to adjust the height of the outlet opening, the height corresponding to a particular contact between the card and the blade, where the contact is related to the separating force. Thus, for a particular gate position, the card being fed through the outlet opening may experience a different separating force depending on card thickness.

That is, if the card thickness increases over the card thickness corresponding to the position of the gate, a larger portion of the blade contacts the card fed through the outlet opening. The increased contact with the blade thereby increases the separating force and, depending on the thickness of the card, the separating force can become greater than the driving force provided by the card drive. Such an occurrence may undesirably cause card misfeeds. On the other hand, if the card thickness decreases compared to the card thickness corresponding to the position of the gate, a smaller portion of the blade contacts the card fed through the outlet opening. The thinner card thereby experiences a decreased separating force due to the decreased contact with the blade and, as a result, the separating force can become lesser than the sticking force between cards. Such an occurrence may undesirably cause double-feeding of the cards.

While the Meier '758 patent allows the gate to be moved so as to accommodate varying card thicknesses by varying the separating force, the range of card thicknesses that can be fed at each gate position may be limited or a large number of closely spaced gate positions may be necessary for the card feeder to be effective over a large range of card thicknesses. This limitation may be at least partially due to the particular configuration of the flexible blade, which may have a flexibility only be suitable for narrow range of card thicknesses. That is, the gate adjustment is related to the contact between the blade and the card fed through the outlet opening, which is generally effective for a range of card thicknesses, while the blade flexibility is selected to provide a particular range of separating force. As such, if a particular card has a thickness toward a high end of the thickness range, the blade may not provide a suitable separating force for the card greater than the sticking force between cards, while a card thickness toward a low end of the thickness range may experience a separating force from the blade that exceeds the driving force from the card drive.

Thus, there exists a need for a feeder device capable of supplying media, such as cards, stock, paper, cardboard, etc. to a print engine in a secure, reliable, and efficient manner, without such undesirable occurrences as, for example, multi-card feeding or misfeeds, if the hopper is not empty. Such a feeder device should desirably provide effective media feeding for different types of material, for different thicknesses, and for media throughout the stack of media, from the first media unit to last media unit in the stack.

BRIEF SUMMARY OF THE INVENTION

The above and other needs are met by the present invention which, according to one aspect, provides a feeder device for feeding a media unit from a stack of media units to a receiving apparatus, wherein each media unit has a thickness. Such a feeder device comprises a drive mechanism adapted to drive a media unit from the stack of media units in a feed direction. A gate apparatus defines an opening having a height, and is aligned with the drive mechanism such that the drive mechanism feeds the driven media unit in the feed direction through the opening. A flexible blade member is fixedly engaged with the gate apparatus at a fixed end, and is cantilevered with respect to the gate apparatus so as to define a free end extending toward the drive mechanism. The blade member defines a length between the fixed end and the free end, and extends from the fixed end so as to reduce the height of the opening. The blade member is further configured such that the flexibility thereof is adjustable, whereby the adjustable flexibility of the blade member and the interaction thereof with the drive mechanism corresponds to the thickness of the driven media unit being fed to the receiving apparatus. A biased member is disposed opposite the driven media unit from the drive mechanism and upstream of the blade member with respect to the feed direction. The biased member is configured to bias the driven media unit against the drive mechanism, as the driven media unit is fed therebetween in the feed direction, so as to separate the driven media units from other media units and to increase a driving force on the driven media unit fed toward the blade member.

Another aspect of the present invention provides a method of feeding a media unit from a stack of media units to a receiving apparatus with a feeder device comprising a drive mechanism, a biased member, a gate apparatus, and a flexible blade member, wherein each media unit has a thickness. Such a method comprises driving a media unit in a feed direction with the drive mechanism, through an opening defined by the gate apparatus and aligned with the drive mechanism. The flexibility of the blade member is then adjusted such that the interaction thereof with the drive mechanism corresponds to the thickness of the driven media unit being fed to the receiving apparatus, wherein the blade member is fixedly engaged with the gate apparatus at a fixed end and is cantilevered with respect to the gate apparatus so as to define a free end extending toward the drive mechanism, and wherein the blade member defines a length between the fixed end and the free end, and extends from the fixed end so as to reduce the height of the opening. The driven media unit is biased against the drive mechanism with a biased member, disposed opposite the driven media unit from the drive mechanism and upstream of the blade member with respect to the feed direction, as the driven media unit is fed therebetween in the feed direction, so as to separate the driven media units from other media units and to increase a driving force on the driven media unit fed toward the blade member.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 6B:
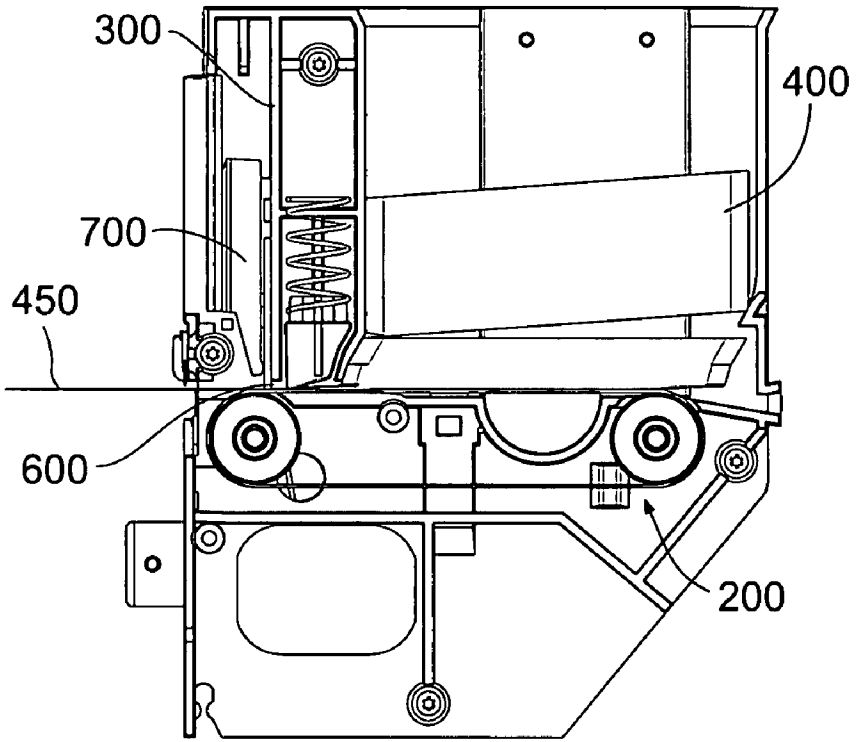
FIGS. 6A and 6B are cut-away perspective and side views of a feed gate apparatus having an adjustably flexible blade according to one embodiment of the present invention.
Figure 6A:
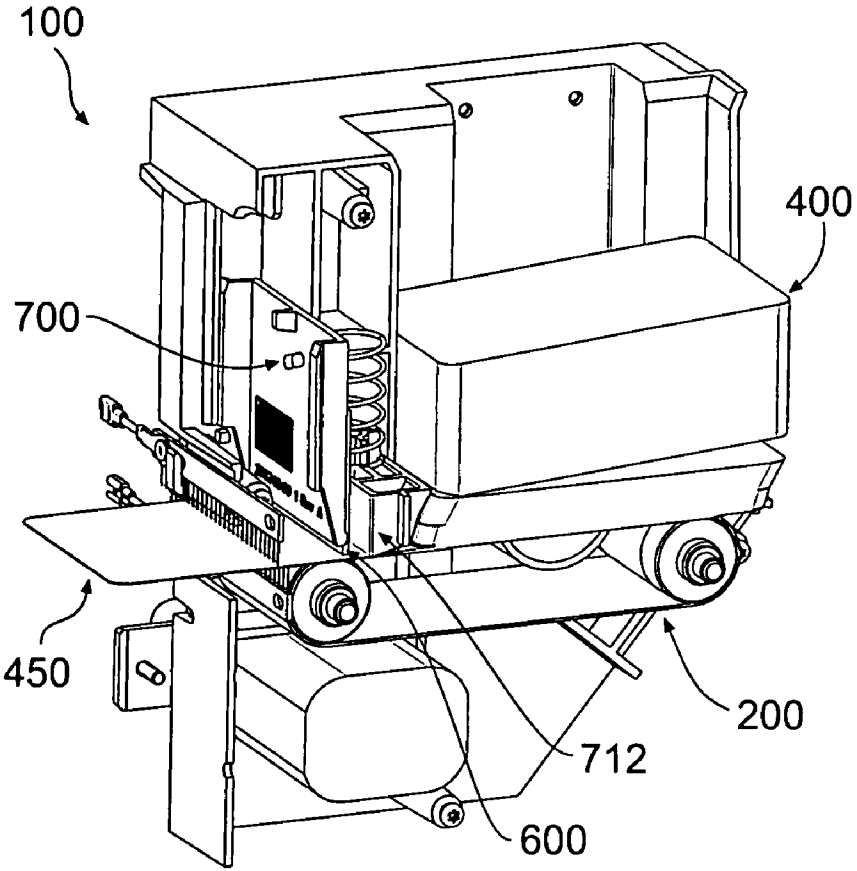
Figures 7A, 7B:
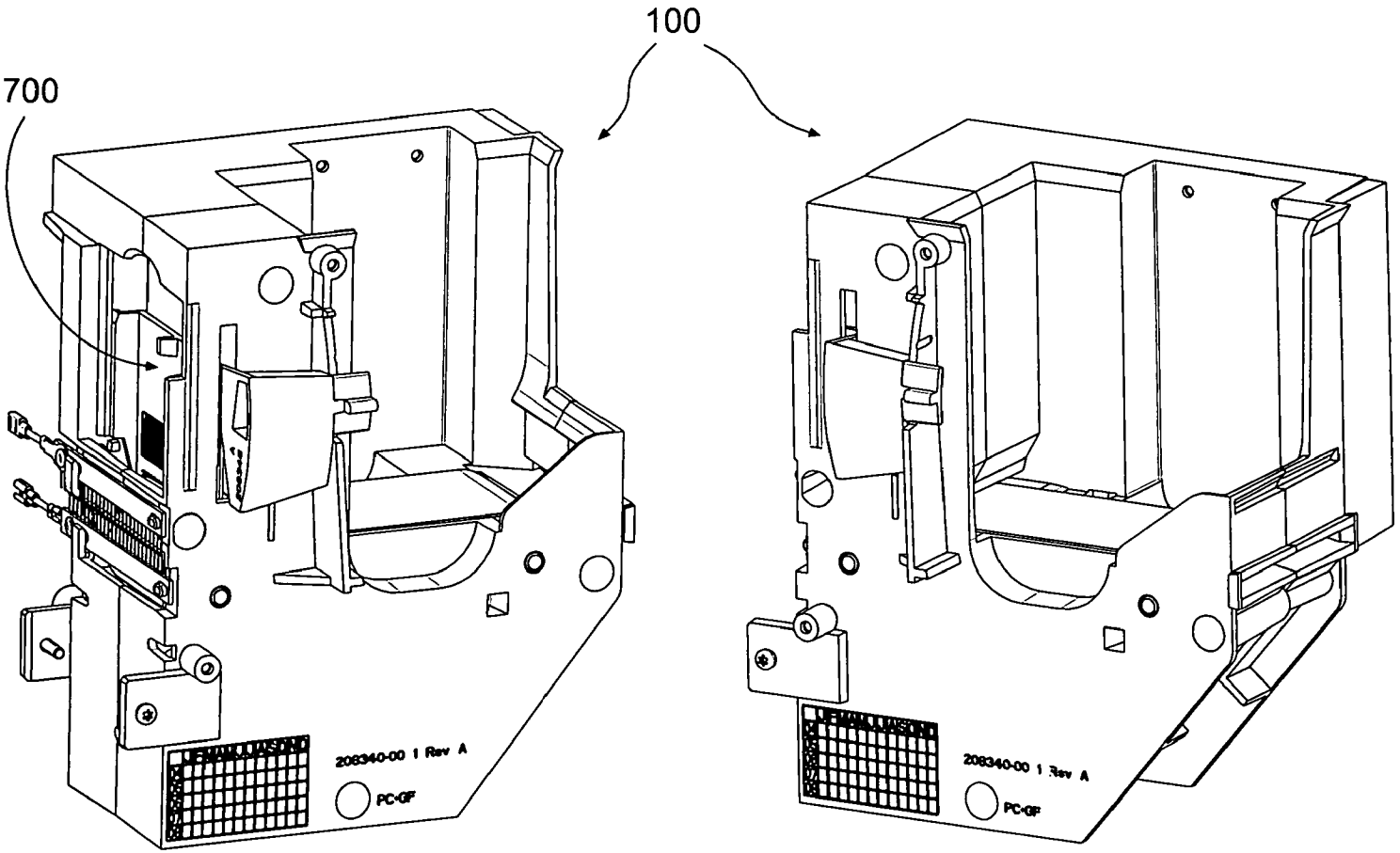
FIGS. 7A-7F are various views of a feed gate apparatus having an adjustably flexible blade according to the embodiment of the present invention shown in FIGS. 6A and 6B.
Figures 7C, 7D:
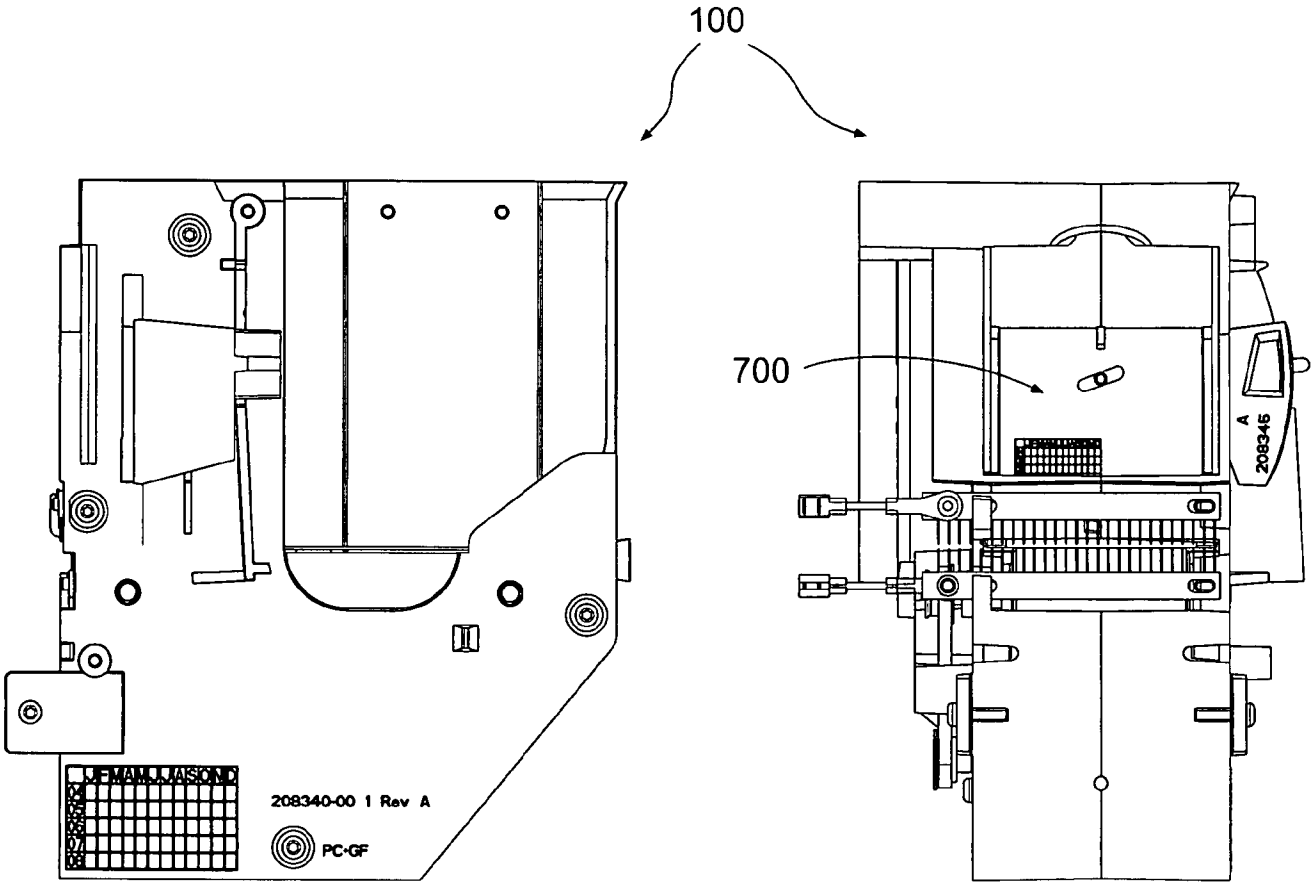
Figures 7E, 7F:
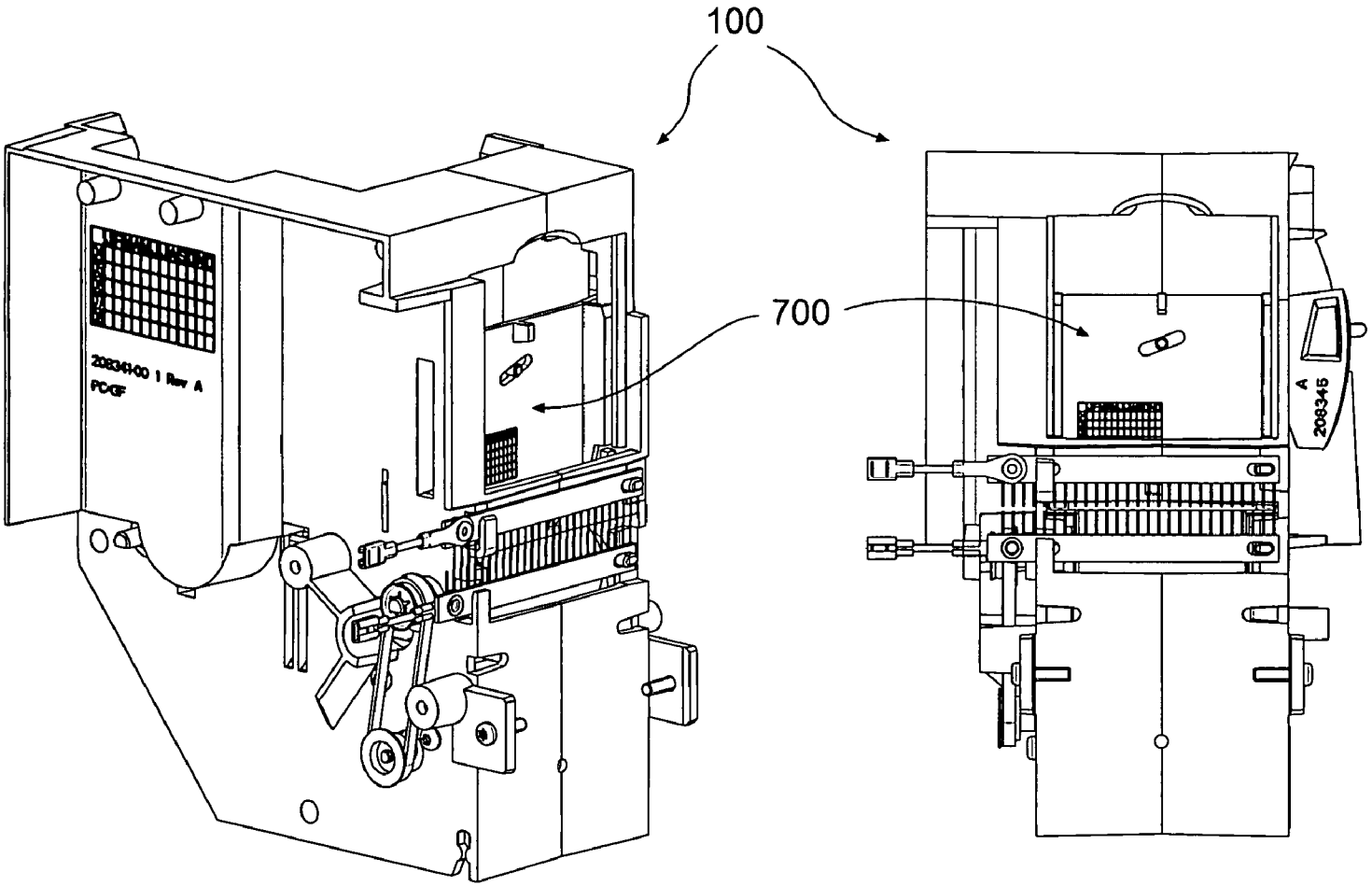
Figure 8A:
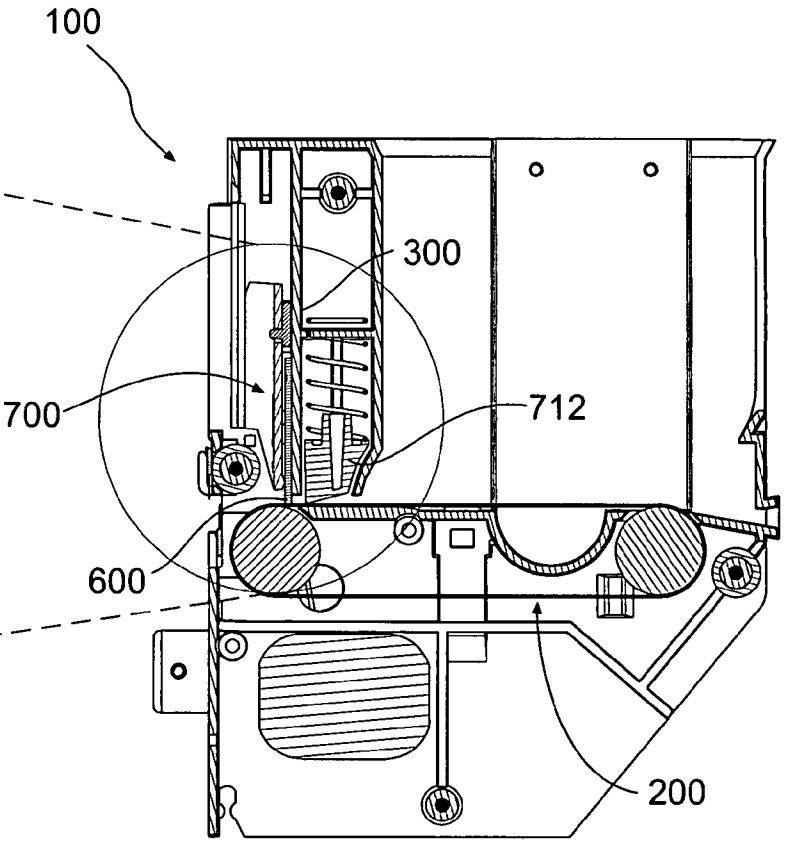
Figure 8B:
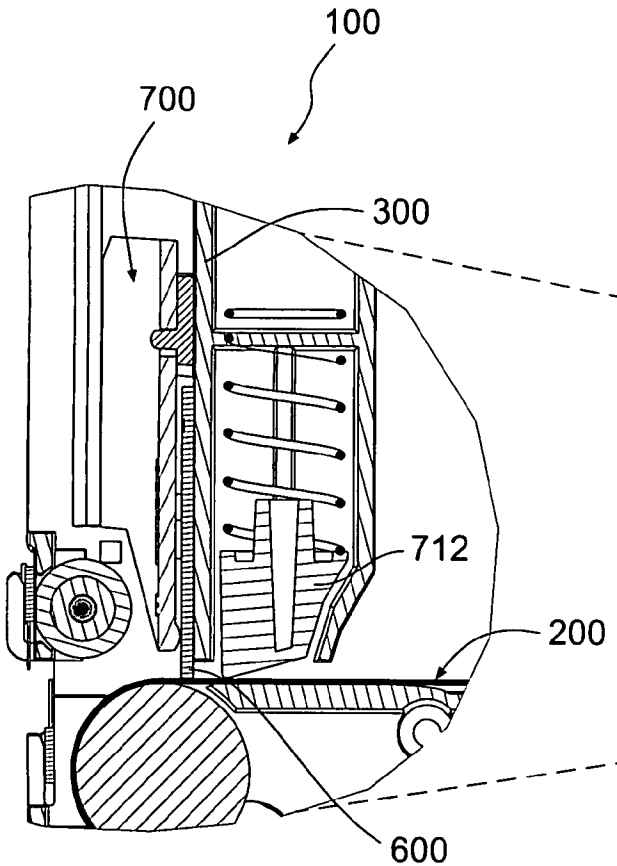
Figures 8C, 8D:
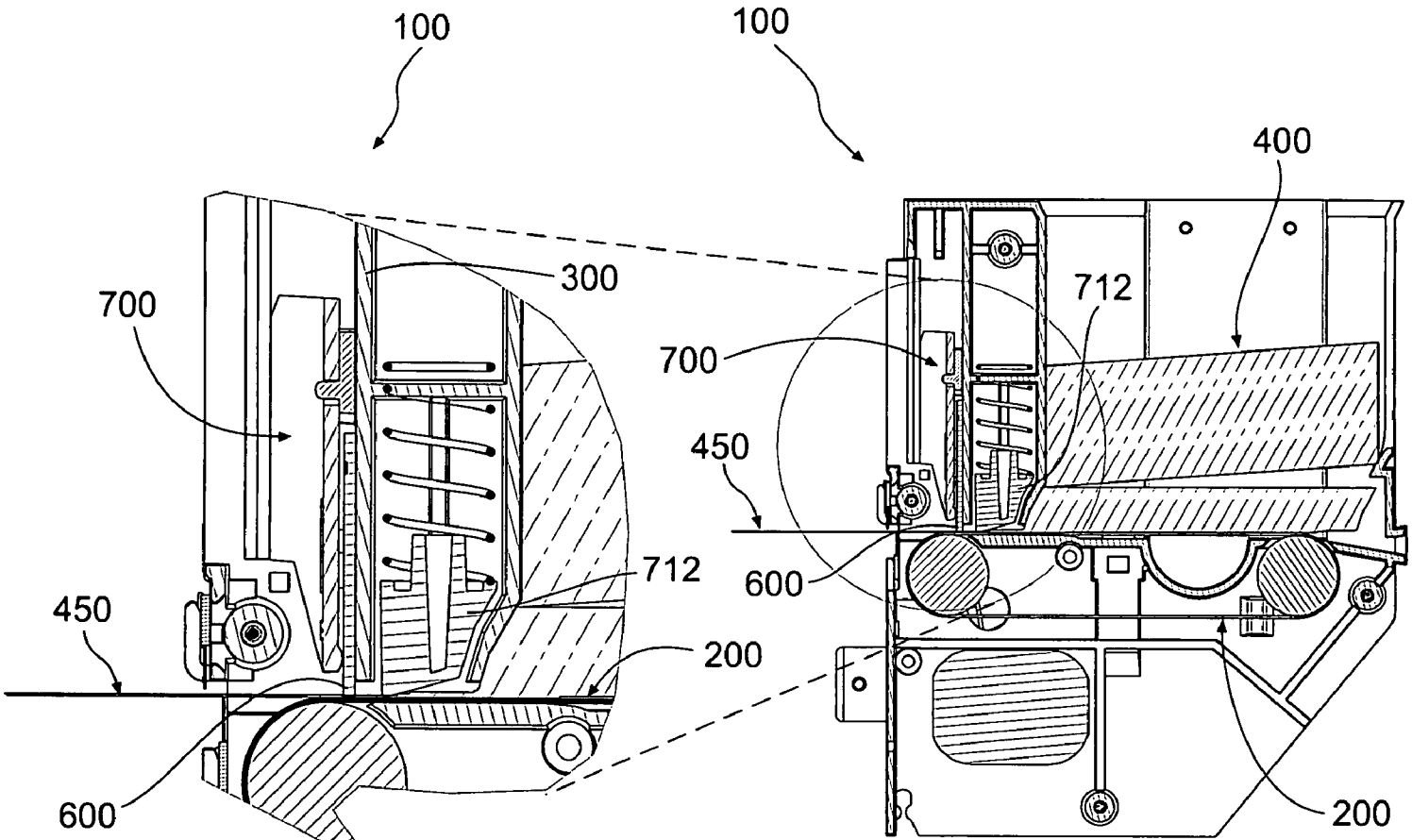

FIGS. 8A and 8B are cross-sectional views of a feed gate apparatus having an adjustably flexible blade according to the embodiment of the present invention shown in FIGS. 6A and 6B; and FIGS. 8C and 8D are cross-sectional views of a feed gate apparatus having an adjustably flexible blade according to the embodiment of the present invention shown in FIGS. 8A and 8B feeding an end card from a stack of cards.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As an initial point, the present invention relates to apparatuses and methods for feeding individual media units to a receiving apparatus. The disclosure provided below demonstrates use of the apparatuses and methods in a card printer, where the individual media units are cards. It will be understood that the examples of the use of embodiments of the invention provided below should not be seen as limiting the invention to printers and card media. The specific examples herein are merely presented here so as to provide a more complete understanding of the invention and not to limit the scope of the invention. For example, the apparatuses and methods of the present invention can be used in any environment where individual media from a stack of media is provided to a receiving apparatus. Such apparatuses and methods can be used to provide media, such as cards, stock, paper, cardboard, etc. to a printer, to provide labels or other stock material to a production line, etc.

As further detailed herein, one embodiment provides a feeder device adapted to feed a medium, such as a card, stock, paper, cardboard, etc. to a receiving apparatus, such a printer, copier, etc. The feeder device is adapted to feed the end media unit from a plurality of media units to a receiving apparatus, wherein each media unit has a thickness and the plurality of media units forms a stack. Such a feeder device comprises a drive mechanism adapted to drive the end media unit of the stack in a feed direction through a gate apparatus. The gate apparatus defines an opening and is aligned with the drive mechanism such that the drive mechanism is capable of feeding the end media unit in the feed direction through the opening. The opening extends from a first edge to a second edge of the gate apparatus so as to define a fixed height, greater than the thickness of the end media unit. A flexible blade member is fixedly engaged with the gate apparatus at a fixed end and is cantilevered with respect to the gate apparatus so as to define a free end. The blade member defines a length between the fixed end and the free end, and extends from the first edge toward the second edge so as to effectively reduce the height of the opening. The blade member is further configured such that the flexibility thereof is adjustable, wherein the adjustable flexibility of the blade member is thereby adapted to allow the feeder device to feed media units of varying thickness to the receiving apparatus.

Another advantageous aspect detailed herein comprises a method of feeding a medium, such as a card, stock, paper, cardboard, etc. to a receiving apparatus, such a printer, copier, etc. The feeder device comprises a drive mechanism, a gate apparatus, and a flexible blade member. Each media unit has a thickness and the plurality of media units forms a stack. First, the end media unit of the stack is fed in a feed direction with the drive mechanism, through an opening defined by the gate apparatus and aligned with the drive mechanism. The opening extends from a first edge to a second edge of the gate apparatus so as to define a fixed height greater than the thickness of the end media unit. The blade member is fixedly engaged with the gate apparatus at a fixed end and is cantilevered with respect to the gate apparatus so as to define a free end. The blade member defines a length between the fixed end and the free end, and extends from the first edge toward the second edge so as to effectively reduce the height of the opening. The flexibility of the blade member is then adjusted so as to allow the feeder device to feed media units of varying thickness to the receiving apparatus.

Figure 1:
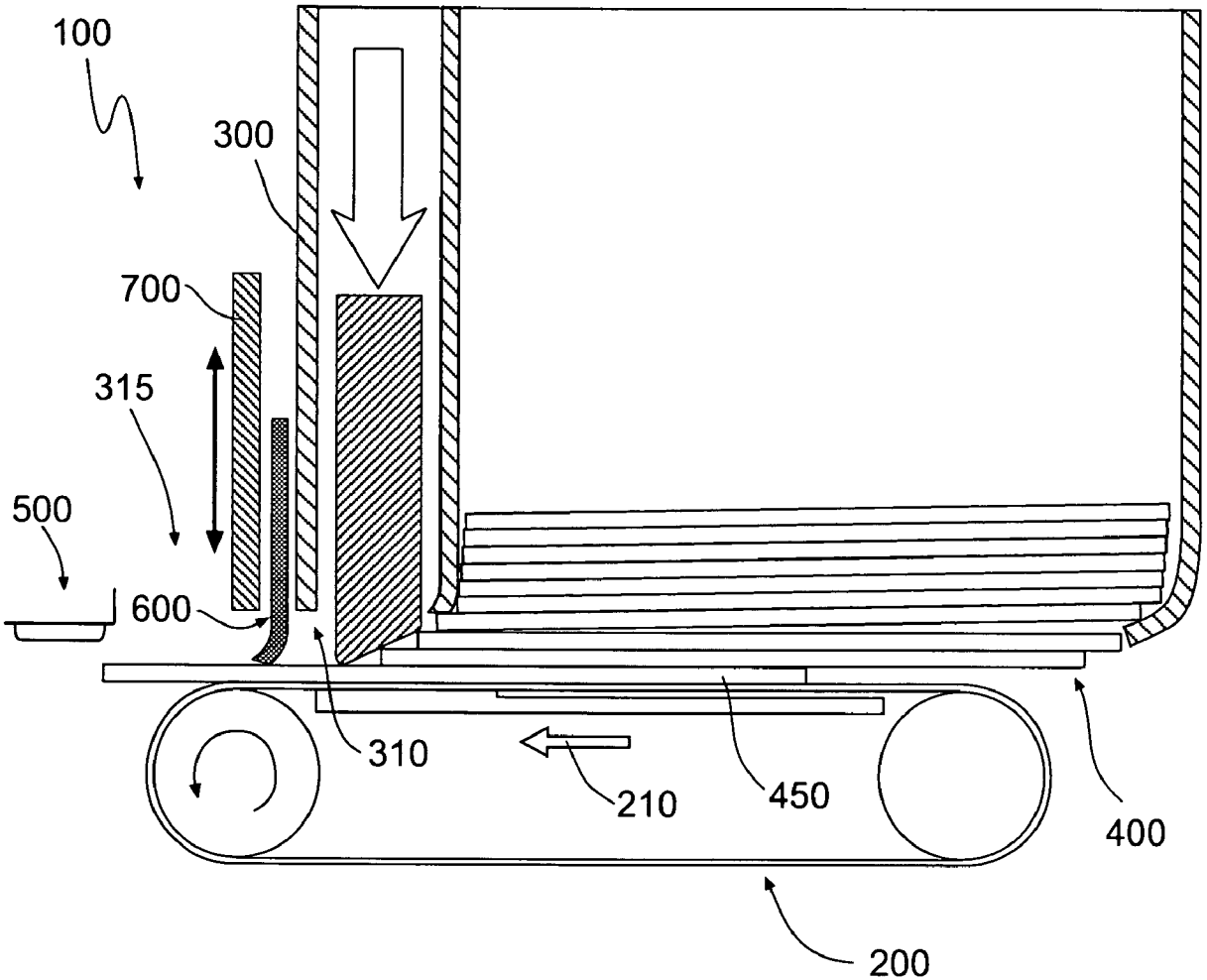
FIG. 1 is a schematic of a feeder device according to one embodiment of the present invention, the feeder device being adapted for use with a receiving apparatus.

FIG. 1 illustrates a feeder device according to one embodiment of the present invention, used to feed cards to a card printer, the feeder device being indicated generally by the numeral 100. The feeder device 100 may comprise, for example, a drive mechanism 200 and a gate apparatus 300. The gate apparatus 300 (otherwise known as or referred to as "the feeder chassis") physically separates or divides a stack of cards or other print medium or media unit 400 from a receiving unit such as a print engine or print apparatus 500 configured to produce a print on an end card 450 from the stack 400. The drive mechanism 200 is configured to engage the end card 450, separate the end card 450 from the stack 400, and then feed or drive the end card 450 through an opening 310 defined by the gate apparatus 300. The end card 450 is thus driven through the gate apparatus 300 to the print engine 500 disposed on the opposite side 315 (otherwise referred to herein as the "downstream side" with respect to the feed direction 210 in which the drive mechanism 200 feeds the end card 450) of the gate apparatus 300.

The drive mechanism 200 is configured to provide a driving force for acting on the end card 450 from the stack 400. The driving force may be provided by, for example, a conveyor-type belt, drive roller(s), or the like, rotating or otherwise advancing in the feed direction 210 such that contact thereof with the end card 450 causes the driving force to be applied to the end card 450. The driving force urges the end card 450 toward the opening 310. In one embodiment, the driving mechanism 200 comprises a conveyor-type belt, as shown in FIG. 1, which increases the contact area between the driving mechanism 200 and the end card 450 over, for example, one or more drive rollers and, as a result, may provide an increased and/or more uniform driving force. However, one skilled in the art will appreciate that other configurations of a driving mechanism 200 suitable for providing the driving force for the end card 450 may be implemented in the embodiments of the invention as described herein consistent with the described principles and that the conveyor-type belt described herein is but one example. In addition, though the drive mechanism 200 provides the driving force for the end card 450, adjacent cards in the stack 400 typically experience an adhesive or sticking force therebetween. That is, the sticking force between the end card 450 and the next adjacent card in the stack tends to resist the driving force separating the end card 450 from the stack 400. The sticking force can be related to or be the result of, for example, electrostatic discharge ("ESD") between cards, cut or folded card edges, the weight of the stack on the end card, the thickness of the cards in the stack, the material comprising the cards, or other factors or combinations thereof.

Generally, in order to separate the end card 450 from the stack 400, such that only the end card 450 is fed through the opening 310 to the print engine 500, a separating force is required in opposing relation to the driving force. That is, a separating force must typically be applied at least against the card in the stack 400 that is adjacent to the end card 450, so as to prevent the sticking force from causing the adjacent card to be affected by the driving force and also driven in the feed direction 210. Accordingly, as previously discussed, the separating force is desirably greater than the sticking force so as to prevent feeding of multiple cards toward the print engine 500. However, due to, for example, variations in card thickness or other factors, the separating force, in some instances, is at least partially applied to the end card 450, as well as the adjacent card in the stack 400. As a result, the separating force preferably does not exceed the driving force since, if the driving force is greater than the separating force, a misfeed or non-feed of the end card 450 may occur.

Figure 2B:
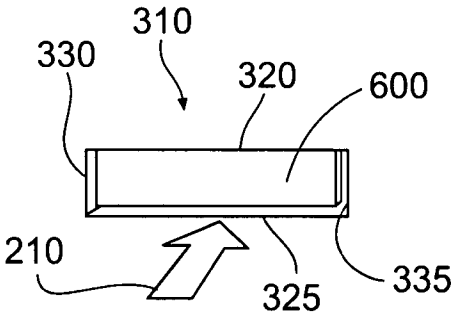
FIG. 2B is a schematic upstream perspective of a feed gate apparatus having an adjustably flexible blade according to one embodiment of the present invention.
Figure 2A:
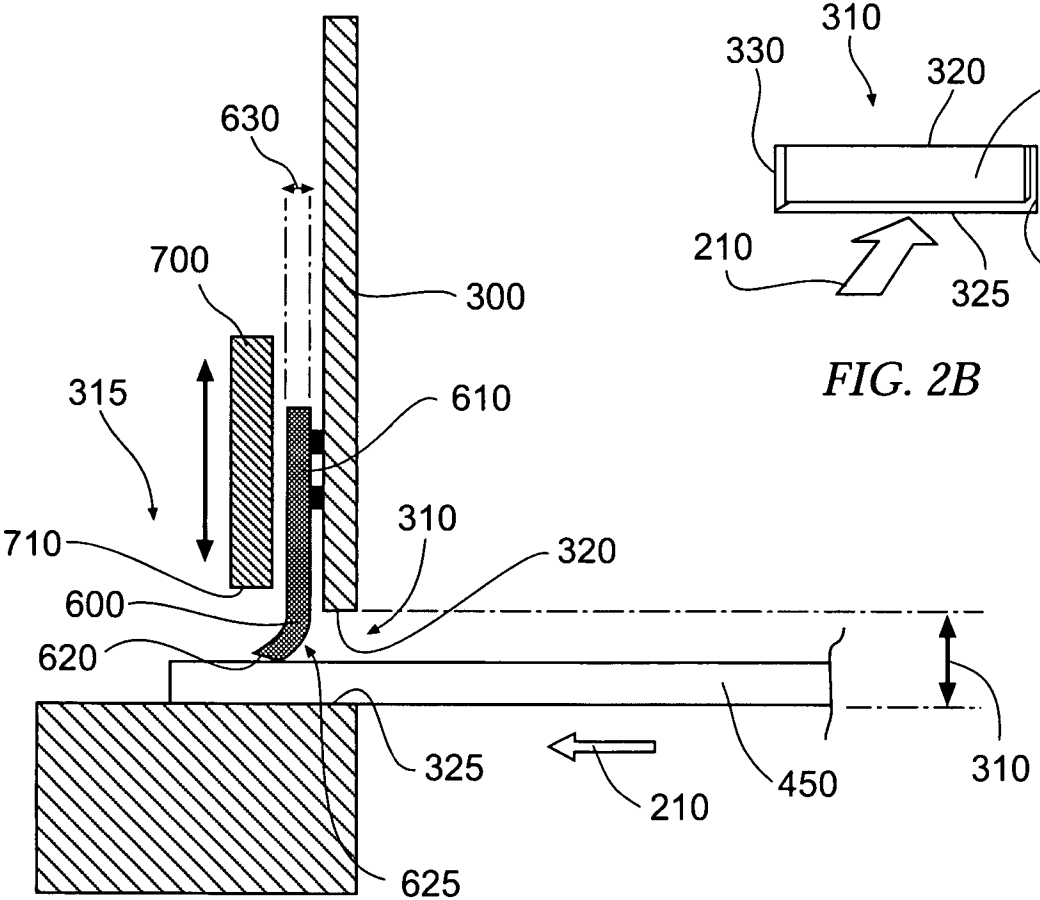
FIG. 2A is a schematic of a feed gate apparatus for a feeder device, the feed gate apparatus having an adjustably flexible blade according to one embodiment of the present invention.

As shown in FIGS. 1, 2A, and 2B, the gate apparatus 300 defines the opening 310 aligned with the drive mechanism 200 (The drive mechanism 200 is omitted from FIGS. 2A, 2B, 3, and 4 for convenience and to facilitate clarity, though the feed direction 210 is illustrated.) and through which end card 450 is fed by the drive mechanism 200 in the feed direction 210. The opening 310 includes a height defined between a first edge 320 and an opposing second edge 325, and a lateral width defined between a first side 330 and an opposing second side 335. In such a configuration, both the height and the width of the opening 310 are fixed. Preferably, the height of the opening is at least as great as the thickness of the thickest card that is fed by the feeder device 100. In a similar manner, the width is preferably is at least as great as the width of the widest card to be fed by the feeder device 100. For instance, one embodiment of the present invention is particularly configured to feed a card having a length of about 86 mm, a width of about 54 mm, and a thickness of between about 9 mils and about 60 mils, where 1 mil=1/1000 inch. However, such dimensions are provided herein for exemplary purposes only and are not intended in any way to be limiting with respect to the dimensions of a card that may be accommodated by embodiments of a feeder device 100 as described herein. If necessary, the height and width of the opening 310 may be configured to be adjustable to accommodate various card configurations.

A flexible blade member 600 is operably engaged with the gate apparatus 300 so as to extend across the first edge 320, from the first edge 320 toward the second edge 325 so as to reduce the height of the opening 310. In one embodiment, for example, the blade member extends to within about 0.1 mm of the second edge 325 of the opening 310. The blade member 600 is comprised of a flexible material such as, for example, a thermoelastic material. In one embodiment, the blade member 600 is comprised of a silicone elastomer, such as a silicone rubber, having a hardness of, for example, between about 50 and about 70 Shore (Durometer). However, one skilled in the art will appreciate that the hardness of the material is but one factor determining the suitably of the blade member 600 for the purposes described herein. That is, many other factors regarding the blade member 600 and associated components may otherwise determine the suitability of the blade member 600 for the purposes described herein and any exemplary configurations described herein are not, in any way, intended to be limiting with respect to alternate configurations.

In one embodiment, as particularly shown in FIG. 2A, the blade member 600 is mounted to fixedly engaged with the gate apparatus 300, at a fixed end 610 of the blade member 600, such that the blade member 600 is cantilevered with respect to the gate apparatus 300. The blade member 600 thus includes a free end 620 opposing the fixed end 610, the distance therebetween defining a length 625 of the blade member 600. As also shown, the blade member 600 has a substantially constant thickness 630 (between the upstream and downstream sides of the blade member 600) along its length in some embodiments, with the thickness 630 being about 1.5 mm in one example. Further, in one embodiment, the blade member 600 may be particularly engaged with the gate apparatus 300 on the downstream side 315 thereof. Thus, as configured, the blade member 600 is capable of flexing, at least downstream in the feed direction 210, in response to being contacted by the end card 450 being fed toward and through the opening 310 by the drive mechanism 200. The material comprising the blade member 600, as well as the configuration of the blade member 600 and the mounting thereof to the gate apparatus 300, contribute at least partially to the flexible nature of the blade member 600.

As previously discussed, the drive mechanism 200 drives the end card 450 toward the opening 310, but other cards in the stack 400 may tend to follow the end card 450 toward the opening due to the sticking force between cards. One purpose of the blade member 600, in this regard, is to exert a net separating force on the other cards in the stack 400, greater than the sticking force between cards, so as to allow the end card 450 to be separated from the stack 400. Accordingly, the driving force on the end card 450 must be greater than the separating force exerted by the blade member 600 on the end card 450 to allow the card 450 to be fed to the print engine 500.

One skilled in the art will appreciate that the discussion herein of the behavior of the flexible blade member 600 is a simplified treatment of the underlying mechanical or other modeling principles applicable to the configuration of the blade member 600 and its interaction with other components. For example, a cantilever beam model may be appropriate and applicable to a cantilevered blade member 600 as discussed in relation to selected embodiments of the present invention. Accordingly, the simplified discussion presented herein is provided as an exemplary illustration of the principles and behavior underlying the various embodiments of the present invention and is not intended to be limiting in any manner with respect to the various models, which may be implemented to analyze various embodiments with increased detail. In addition, one skilled in the art will also appreciate that there may be many different manners of operably engaging the blade member 600 with the gate apparatus 300 and/or the adjusting member 700. Accordingly, the interaction between the blade member 600, the gate apparatus 300, and/or the adjusting member 700 may, in such instances, be represented by a model other than a cantilever beam model. Accordingly, the configurations presented herein are for example only and are not intended to be limiting with respect to the interaction between the blade member 600, the gate apparatus 300, and/or the adjusting member 700.

Having presented a basic overview of the behavior of a cantilevered blade member 600, additional aspects of the present invention are now addressed. More particularly, some embodiments of the present invention further include an adjusting member 700 (otherwise referred to herein as an "adjustment element") operably engaged with the blade member 600 so as to allow the flexibility of the blade member 600 to be adjusted to accommodate different ranges of card thicknesses.

The feeder device 100 may be configured to feed cards having varying thickness. As a result of varying card thickness, sticking force between cards, and/or other factors, the separating force exerted by the blade member 600 may vary. The blade member 600 may thus have a range of card thicknesses (also referred to herein as "the optimal thickness range") over which the relationship of driving force ($F_d$)>separating force ($F_{sp}$)>sticking force ($F_{st}$) remains valid. If the thickness of the card falls below the optimal thickness range, the end card 450 contacts the blade member 600 closer to the free end 620. However, since the blade member 600 has a substantially constant thickness 630 along its length 625, the flexibility or elastic modulus of the blade member 600 is also substantially constant along the length 625. That is, the thinner end card 450 contacts the blade member 600 further away from the fixed end 610, where the resistance of the blade member 600 to deflection decreases, as compared to a card within the optimal thickness range. Accordingly, the separating force exerted by the blade member 600 toward the free end 620 may decrease to less than the sticking force, thereby undesirably increasing the risk of multiple card feeding. Conversely, for a card thickness above the optimal thickness range, the card 450 contacts the blade member 600 closer to the fixed end 610, where the resistance to deflection increases, as compared to a card within the optimal thickness range. As such, the separating force exerted by the blade member 600 toward the fixed end 610 may increase to more than the driving force, thereby undesirably increasing the risk of misfeed or no card being fed.

As shown in FIG. 2A, one embodiment of the present invention includes the adjusting member 700, such as a movable plate, engaged with the blade member 600 so as to be capable of varying the cantilever length 625 of the blade member 600 and thereby vary the flexibility or stiffness thereof in correspondence with the thickness of the card being fed. That is, varying the cantilever length 625 of the blade member 600 correspondingly changes the resistance to deflection of the blade member 600 and thus, in turn, affects the separating force capable of being exerted by the blade member 600. The adjusting member 700, in one embodiment, may be engaged with the gate apparatus 300 such that the blade member 600 is disposed therebetween. Further, the adjusting member 700 may be movable in substantially parallel relation with respect to the portion of the gate apparatus 300 defining the opening 310, toward and away from the opening 310, such that an operative portion 710 of the adjusting member 700 for determining the cantilever length 625 of the blade member 600 is movable from the fixed end 610 toward and away from the free end 620 of the blade member 600. In some instances, the range of movement of the operative portion 710 of the adjusting member 700 may be limited to between about the fixed end 610 of the blade member 600 and the first edge 320 of the opening 310, such that the height of the opening 310 is not impeded by the adjusting member 700. The adjusting member 700 may be, for example, configured to be slidable with respect to the blade member 600 and/or the gate apparatus 300 (feeder chassis), though various other mechanisms for providing suitable adjustability of the adjusting member 700 may otherwise be provided.

In such a configuration, one skilled in the art will appreciate that the adjusting member 700 essentially changes the fixed point or mounting of the cantilevered blade member 600, wherein a shorter cantilever increases the resistance of the blade member 600 to flexing (a greater separating force), while a longer cantilever decreases the resistance of the blade member 600 to flexing (lesser separating force). In some instances, the magnitude of the separating force may be correlated with card thickness. That is, a particular card thickness range may require a particular separating force, wherein a card thickness at or above the upper end of the range may required a decreased separating force and a card thickness at or below the lower end of the range may require an increased separating force. As such, the adjusting member 700 may be disposed at a particular setting with respect to the blade member 600 so as to provide a separating force, via the blade member 600, suitable for a certain card thickness range. For example, where card thicknesses range from about 9 mils to about 60 mils, the flexibility (or capability of providing a necessary separation force) of the blade member 600 may be adjusted by the adjusting member 700, for instance, to one of three discrete settings to provide three card thickness range subsets. A setting of the operable portion 710 of the adjusting member 700 closest to the first edge 320 of the opening 310 may provide the smallest cantilever of the blade member 600 and a suitable separating force, for example, for cards having a thickness of between about 9 mils and about 13-14 mils ("small thickness cards"). A setting of the operable portion 710 of the adjusting member 700 closest to the fixed end 610 of the blade member 600 may provide the largest cantilever of the blade member 600 and a suitable separating force, for example, for cards having a thickness of between about 18 mils and about 60 mils ("large thickness cards"). A setting of the operable portion 710 of the adjusting member 700 medially between the fixed end 610 and the first edge 320 may provide a medium cantilever of the blade member 600 and, as such, a suitable separating force, for example, for cards having a thickness of between about 12 mils and about 20-25 mils ("medium thickness cards").

One skilled in the art will appreciate, however, that many different adjustability schemes may be implemented in order to provide the necessary degree of adjustable flexibility of the blade member 600, within the scope of the present invention. For example, in contrast to the discrete flexibility range adjustments, as discussed, the adjusting member 700 may be configured to be substantially continuously adjustable between the fixed end 610 and the first edge 320. In other instances, the thickness 630 of the blade member 600 may vary along the length 625 thereof (the cross-sectional profile of the blade member 600 may be non-uniform) and, as a result, interaction of the adjusting member 700, if used or necessary, may provide different flexibility or stiffness characteristics of the blade member 600 as compared to a blade member 600 having a uniform cross-sectional profile. In further instances, the flexibility or stiffness characteristics of the blade member 600 may also be configured to vary laterally across the width of the opening 310. For example, the blade member 600 may be configured to provide a separating force in a medial position with respect to the opening 310. That is, in some instances, the blade member 600 may not extend completely across the width of the opening 310, leaving a gap between each side 330, 335 of the opening 310 and the blade member 600. In other instances, the blade member 600 may be, for example, divided into segments, in a similar manner to the fingers or tines of a comb, selectively disposed, or disposed at selected intervals, across the width of the opening 310. Further, the free end 620 of the blade member 600 may be nonlinear, but otherwise configured so as to provide the necessary distribution of separating force across the opening 310.

In still other instances, the flexibility or stiffness characteristics of the blade member 600 may be influenced and/or determined by, for example, the material comprising the blade member 600. That is, with respect to the adjustable flexibility or stiffness of the blade member 600, the degree of flexibility or stiffness of the blade member 600 may be less sensitive with respect to the position of the adjusting member 700 as the material comprising the blade member 600 increases, for example, in hardness, thickness, or modulus of elasticity. For instance, a blade member 600 comprised of silicone rubber having a hardness of about 70 Shore (relatively harder and less flexible) may be less sensitive to the actual position of the adjusting member 700 for providing a desired separation force, than a blade member 600 comprised of the same silicone rubber material and having the same thickness 630, but having a hardness of about 50 Shore (relatively softer, less stiff, and more flexible). In another example, varying the thickness 630 of the blade member 600, while maintaining the same hardness of the silicone rubber material, may also serve to vary the flexibility or stiffness of the blade member 600. That is, for the same hardness of material, a thicker blade member 600 may exhibit less flexibility or more stiffness than a thinner blade member 600 and, as such, a thicker blade member 600 may be less sensitive to the actual position of the adjusting member 700 for providing a desired separation force, when interacting therewith.

Figure 3:
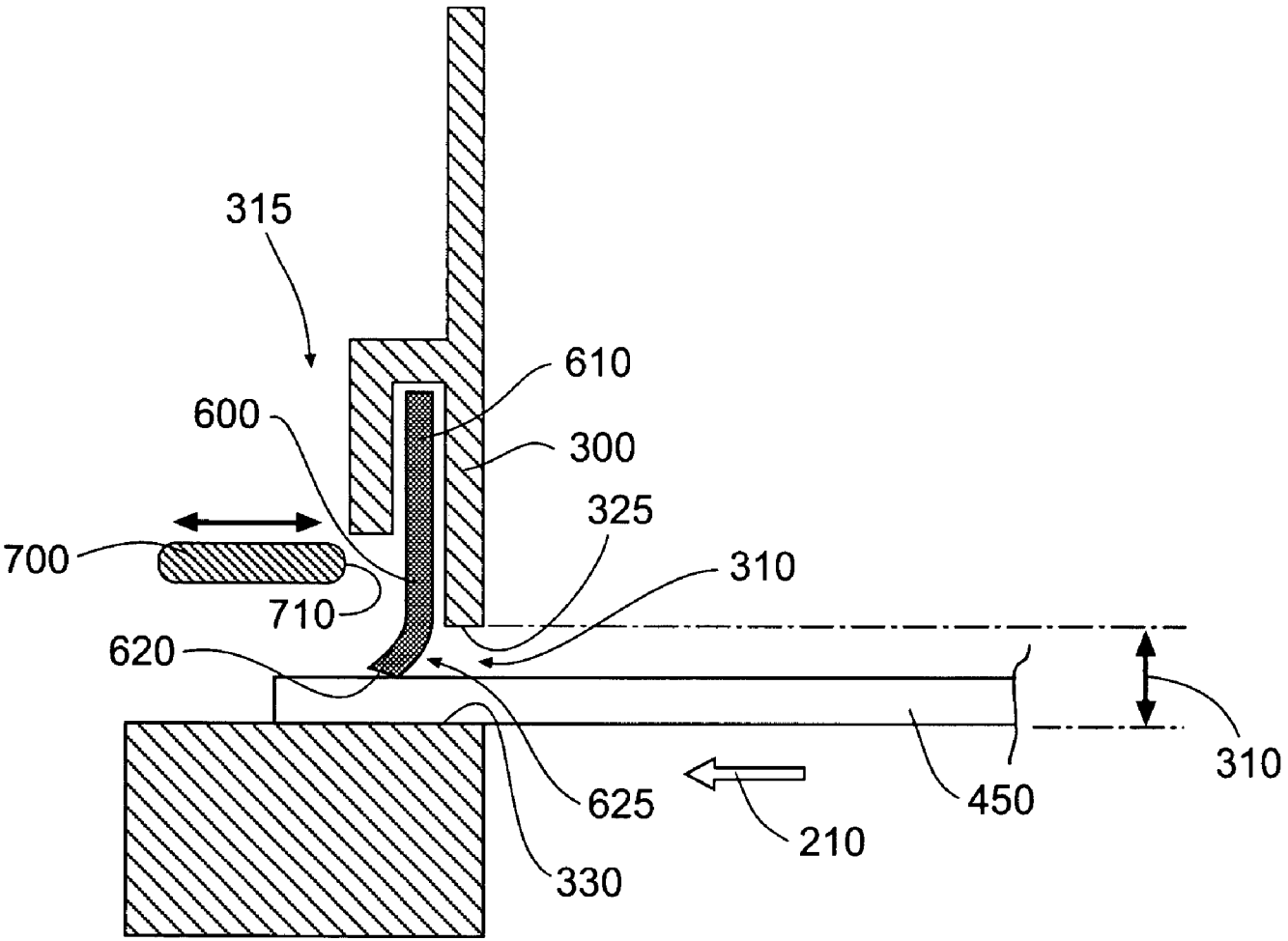
FIG. 3 is a schematic of a feed gate apparatus having an adjustably flexible blade according to an alternate embodiment of the present invention.

Any of the principles discussed herein regarding the adjustably flexibility or stiffness of the blade member 600 may also be applicable to different configurations of the blade member 600 itself. For instance, as shown in FIG. 3, the adjusting member 700 may be operably engaged with the gate apparatus 300 and/or the blade member 600 so as to be movable in substantially perpendicular relation to the gate apparatus 300/opening 310. That is, the adjusting member 700 may be disposed adjacent to the gate apparatus 300 such that the blade member 600 is disposed therebetween. In addition, the adjusting member 700 is disposed medially between the fixed end 610 of the blade member 600 and the first edge 320 of the opening 310 (such that the height of the opening 310 is not reduced), and is configured to be movable toward and away from the blade member 600. In such a configuration, the blade member 600 will be less flexible or more stiff as the operative portion 710 of the adjusting member 700 is adjusted to be closer thereto. More particularly, contact of the blade member 600 with the operative portion 710 of the adjusting member 700 reduces the cantilever length of the blade member 600 and thus reduces the flexibility or increases the stiffness thereof. If such contact occurs relatively close to the gate apparatus 300, the blade member 600 will be less flexible or more stiff since the blade member 600 flexes to a lesser extent in the downstream direction before contacting the operative portion 710 of the adjusting member 700. If the contact occurs relatively remotely with respect to the gate apparatus 300, the blade member 600 will be more flexible or less stiff since the blade member 600 is able to flex to a greater extent in the downstream direction before contacting the operative portion 710 of the adjusting member 700.

Figure 4:
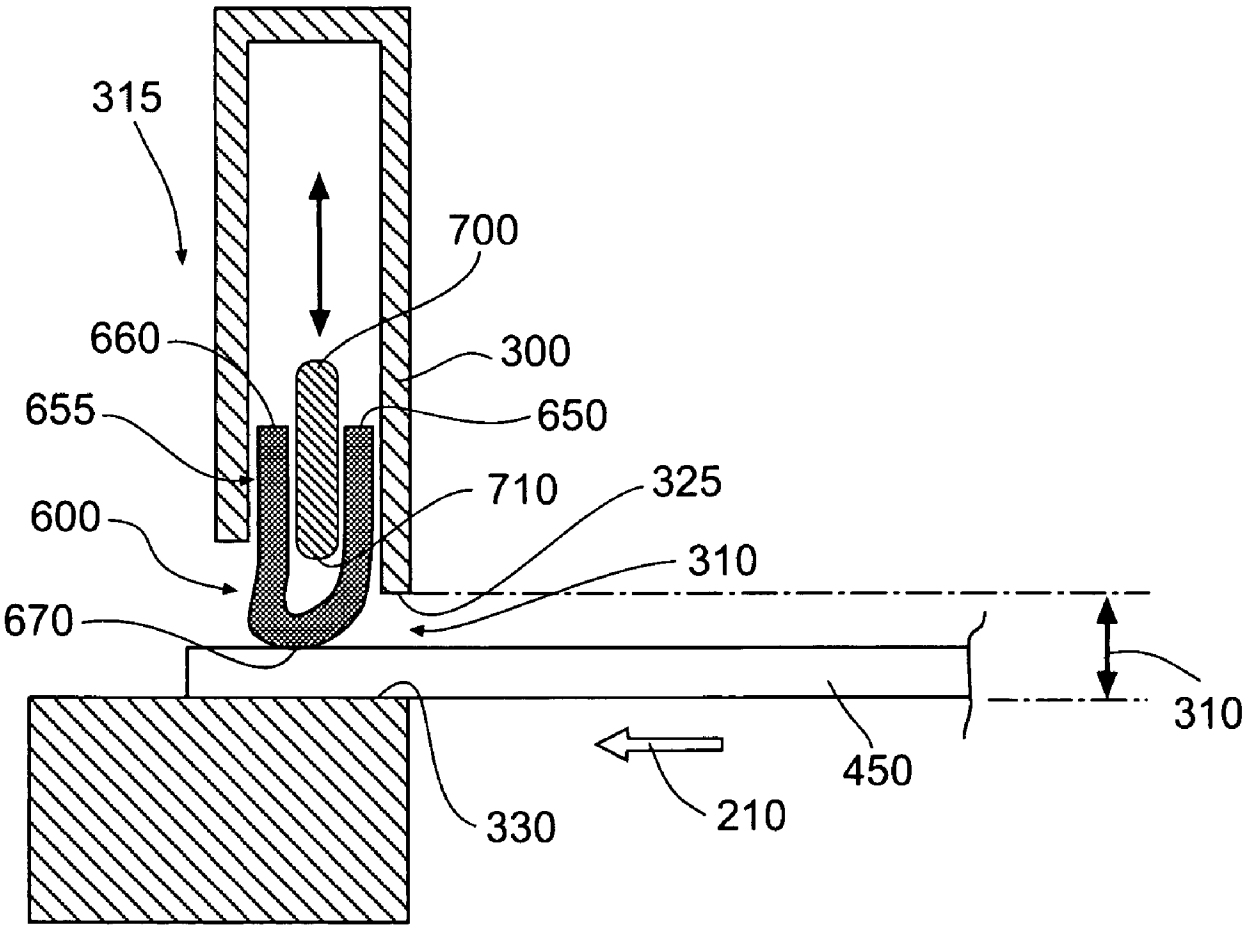
FIG. 4 is a schematic of a feed gate apparatus having an adjustably flexible blade according to another alternate embodiment of the present invention.

In another example, as shown in FIG. 4, the blade member 600 may be configured such that the opposed ends 650, 660 (previously referred to a the "fixed end 610" and "the free end 620") are both operably engaged with the gate apparatus 300, forming a fixed end 655 of the blade member 600 in the illustrated configuration. The ends 650, 660 may be operably engaged with the gate apparatus 300 at substantially the same distance from the first edge 320 of the opening 310 or, in some instances, at different distances. The medial portion of the "folded over" blade member 600 thus extends from the fixed end 655 toward the second edge 325 of the opening to form a free end 670 of the blade member 600 in the illustrated configuration. In such a configuration, the adjusting member 700 is movable in substantially parallel relation to the gate apparatus 300, between the opposed ends 650, 660, such that the operative portion 710 is adjustable between the fixed end 655 and the first edge 320 of the opening 310. That is, the adjusting member 700 is movable within the fold of the blade member 600 such that the position of the operative end 710 of the adjusting member 700 within the fold of the blade member 600 determines the effective length 625 or extent of flexibility or stiffness of the blade member 600.

As mentioned in the above embodiments, the position of the adjusting member 700 should generally correspond to the thickness of the card being fed. The position of the adjusting member, for determining the flexibility or stiffness of the blade member 600, may be controlled manually, such as being manually positioned by the operator of the printer. Further, the adjustment of the adjusting member 700 may be automatically performed. By using an automatic positioning system for the adjusting member 700, the apparatuses and methods of the present invention may dynamically adjust to card thickness and thus be more effective, for example, in instances where the card thickness of the cards in the stack varies. For instance, the apparatuses and methods may adjust to the thickness of a card without operator input. As such, the operator could, in some instances, load a stack having cards of different thickness, with the apparatuses and methods automatically adjusting the position of the adjusting member 700 to accommodate the thickness of each card.

Figure 5A:
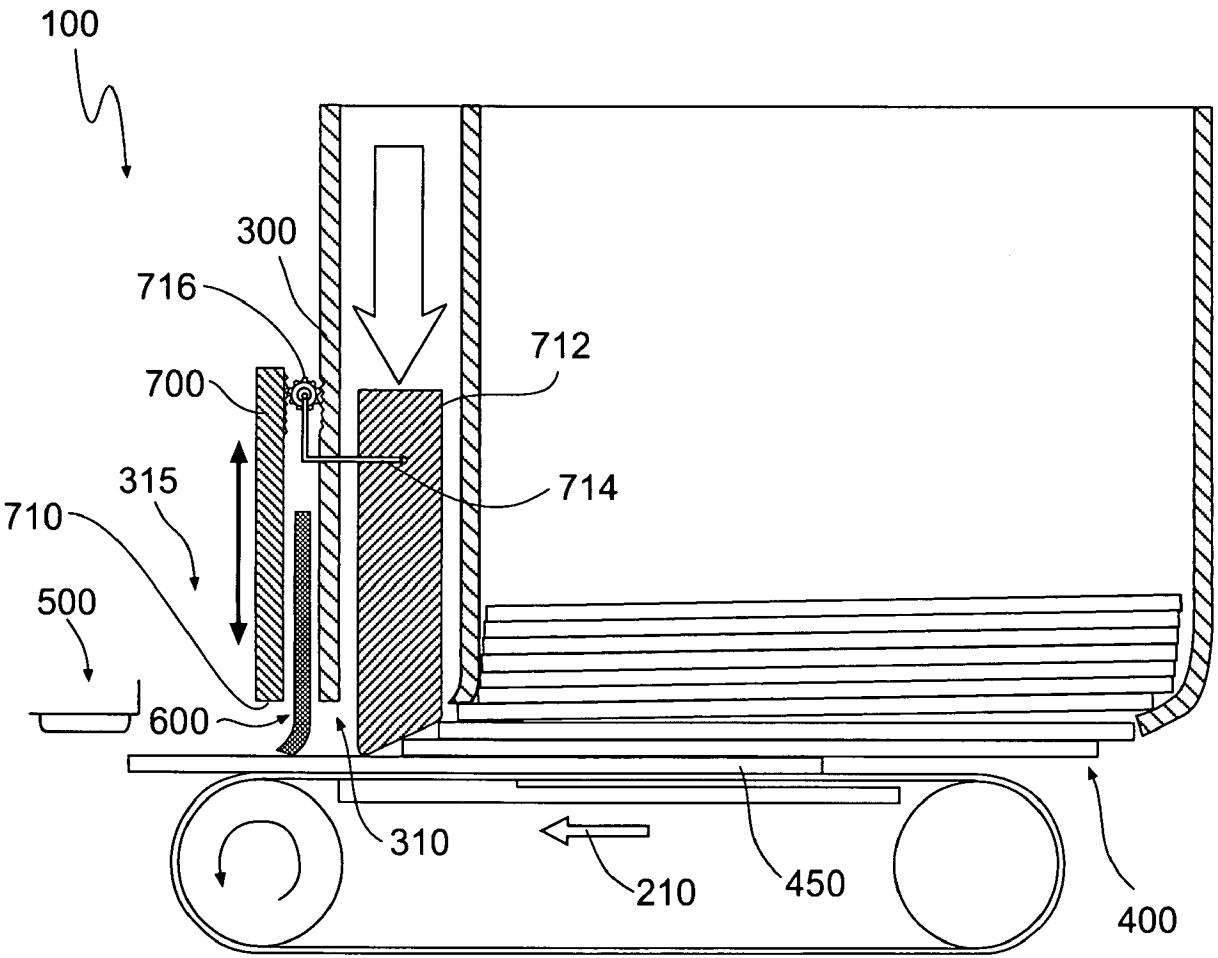
FIGS. 5A-5D are schematics illustrating a feed gate apparatus having an adjustably flexible blade and alternate embodiments of a mechanism operably engaged with the feed gate apparatus for determining the thickness of the media unit being fed and correspondingly adjusting the flexibility of the blade, according to one aspect of the present invention.

With respect to positioning the adjusting member 700, FIG. 5A illustrates an embodiment of the present invention, which uses a mechanical system to sense the thickness of the card 450 and to adjust the adjusting member 700 accordingly. In this embodiment, a biased member 712 is provided for forcing a leading edge of the end card 450 against the drive mechanism 200. (Such a biased member is discussed more fully in U.S. patents application No. 10/837,903, entitled "FEEDER DEVICE HAVING INCREASED MEDIA CAPACITY AND MULTIPLE MEDIA THICKNESS FEED CAPABILITY AND ASSOCIATED METHOD," filed May 3, 2004. As illustrated, the distal portion of the biased member 712 contacts the end card 450, as the end card 450 is being fed, and is moved away from the drive mechanism 200 to an extent relative to a thickness of the end card 450. In the embodiment illustrated in FIG. 5A, a linkage 714 is configured and engaged between the biased member 712 and the adjusting member 700. The linkage 714 includes, for example, a gear 716 for defining the adjustment of the adjusting member 700 relative to the displacement of the biased member 712 by the end card 450 relative to the drive mechanism 200. That is, for example, if the biased member 712 is displaced to a lesser extent when an end card 450 of relatively smaller thickness is provided and fed, the operative portion 710 of the adjusting member 700 will also be adjusted so as to shorten the blade member 600 and thereby stiffen the blade member 600 appropriately to accommodate the thinner card 450.

Figure 5B:
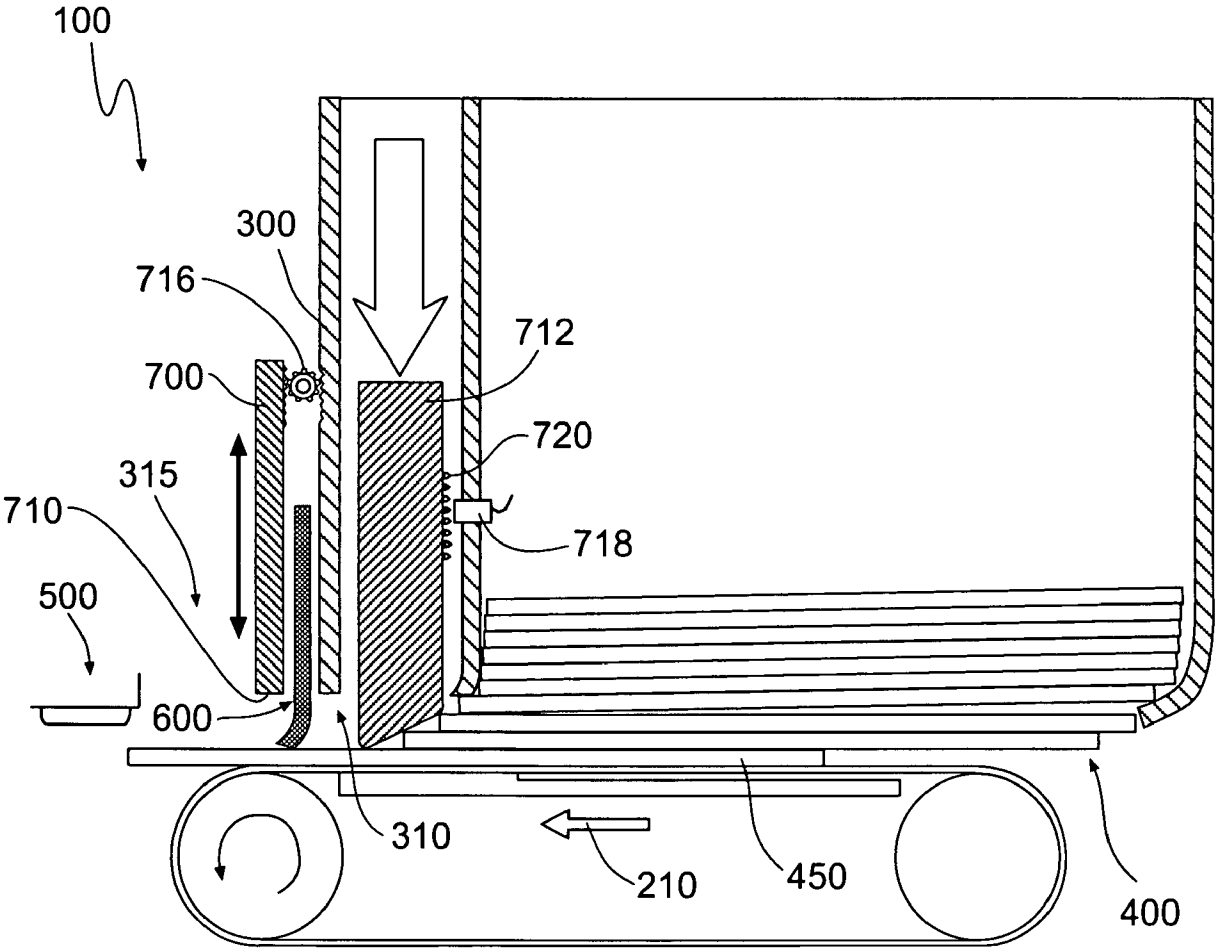

FIG. 5B illustrates an alternative embodiment, in which a sensor 718 is used to determine the relative displacement of the biased member 712 with respect to the drive mechanism 200. In this embodiment, the sensor 718 may be, for example, an optical sensor, capacitance sensor, etc. configured to detect, for instance, the placement of tick marks 720 located on the biased member 712. The displacement of the biased member 712 detected by the sensor 718 is provided, for example, to a processor (not shown) that is also connected to a stepper motor (not shown) that engages the gear 716. Based on the detected displacement of the biased member 712 and in response thereto, the processor controls the gear 716 to set the proper position for the operative portion 710 of the adjusting member 700 in relation to the thickness of the card 450 being fed.

Figure 5C:
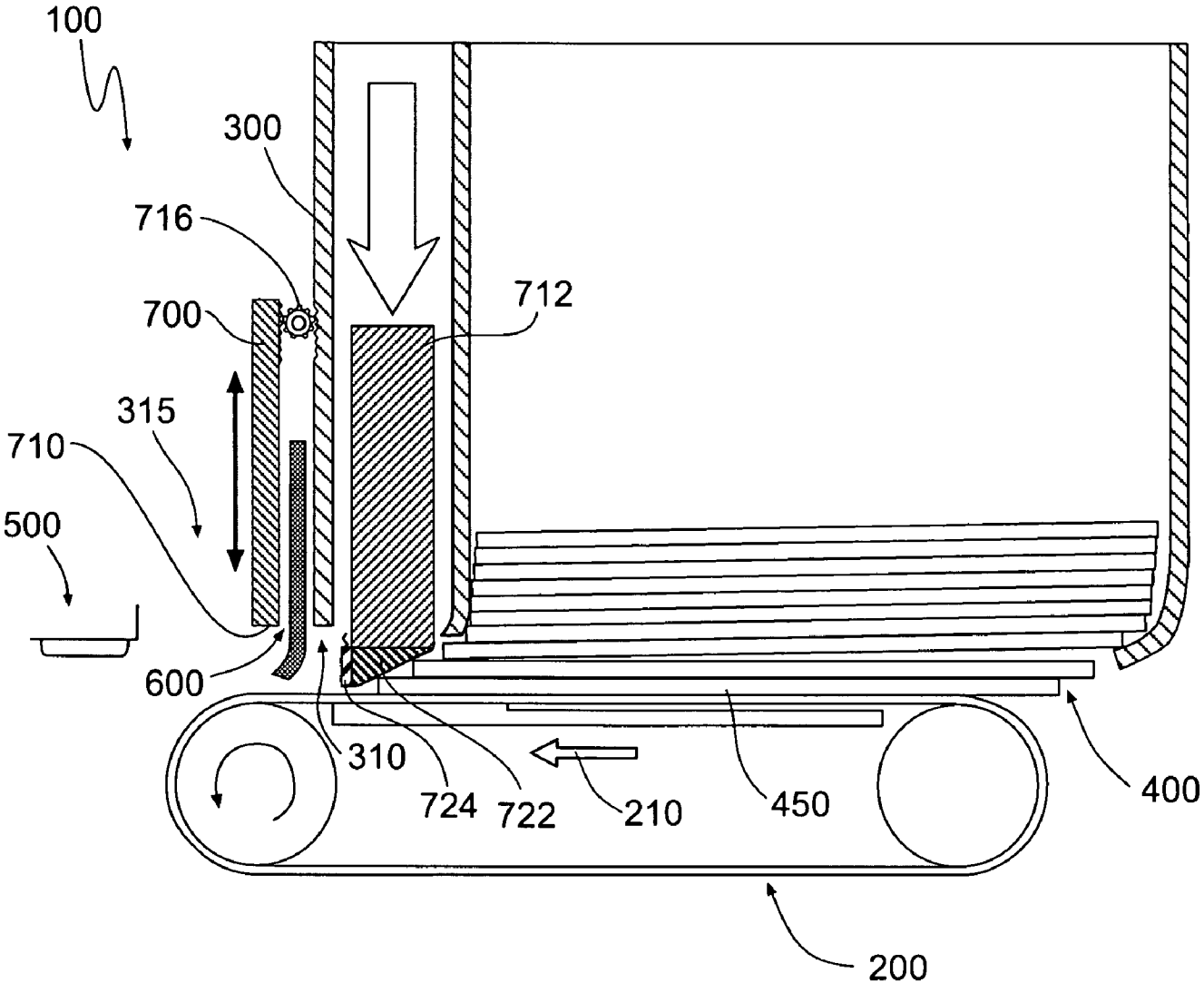

FIG. 5C illustrates yet another embodiment of the present invention illustrating an automated device for adjusting the position of the adjusting member 700. In this embodiment, a "story board" 722 or the like is operably engaged with the biased member 712 in such a manner as to be capable of contacting a leading edge of the end card 450 approaching the biased member 712. Opposite the story board 722 from the approaching end card 450 is a sensor 724. In this embodiment, the story board 722 is disposed between the leading edge of the end card 450 and the sensor 724 and the story board 722. The sensor 724 is configured to determine how much of the story board 722 is engaged by the leading edge of the card 450, to thereby determine the thickness of the card 450, wherein the corresponding measurement is fed to a processor (not shown) that uses a stepper motor (not shown) to adjust the position of the adjusting member 700. Otherwise, the biased member 712 interacts with the end card 450 in a manner described herein as well as in U.S. patent application No. 10/837,903, entitled "FEEDER DEVICE HAVING INCREASED MEDIA CAPACITY AND MULTIPLE MEDIA THICKNESS FEED CAPABILITY AND ASSOCIATED METHOD," filed May 3, 2004. In this embodiment, any number of sensor systems may be employed to determine the thickness of the card 450. For example, in one embodiment, the story board 722 may be of a different color than the card 4S0, wherein the sensor 724 may then detect the thickness of the card 4S0 by noting the transition in color between the card 4S0 and the story board 722. In another embodiment, the story board 722 may include bar codes or other indicia indicating different card thicknesses, whereby the sensor 724 detects lowest visible indicia on the story board 722 not covered by the card thickness. Furthermore, the sensor 724 may be, for example, a capacitive sensor that detects capacitive differences between the sensor 724 and the story board 722 in order to determine the thickness of the card 450.

Figure 5D:
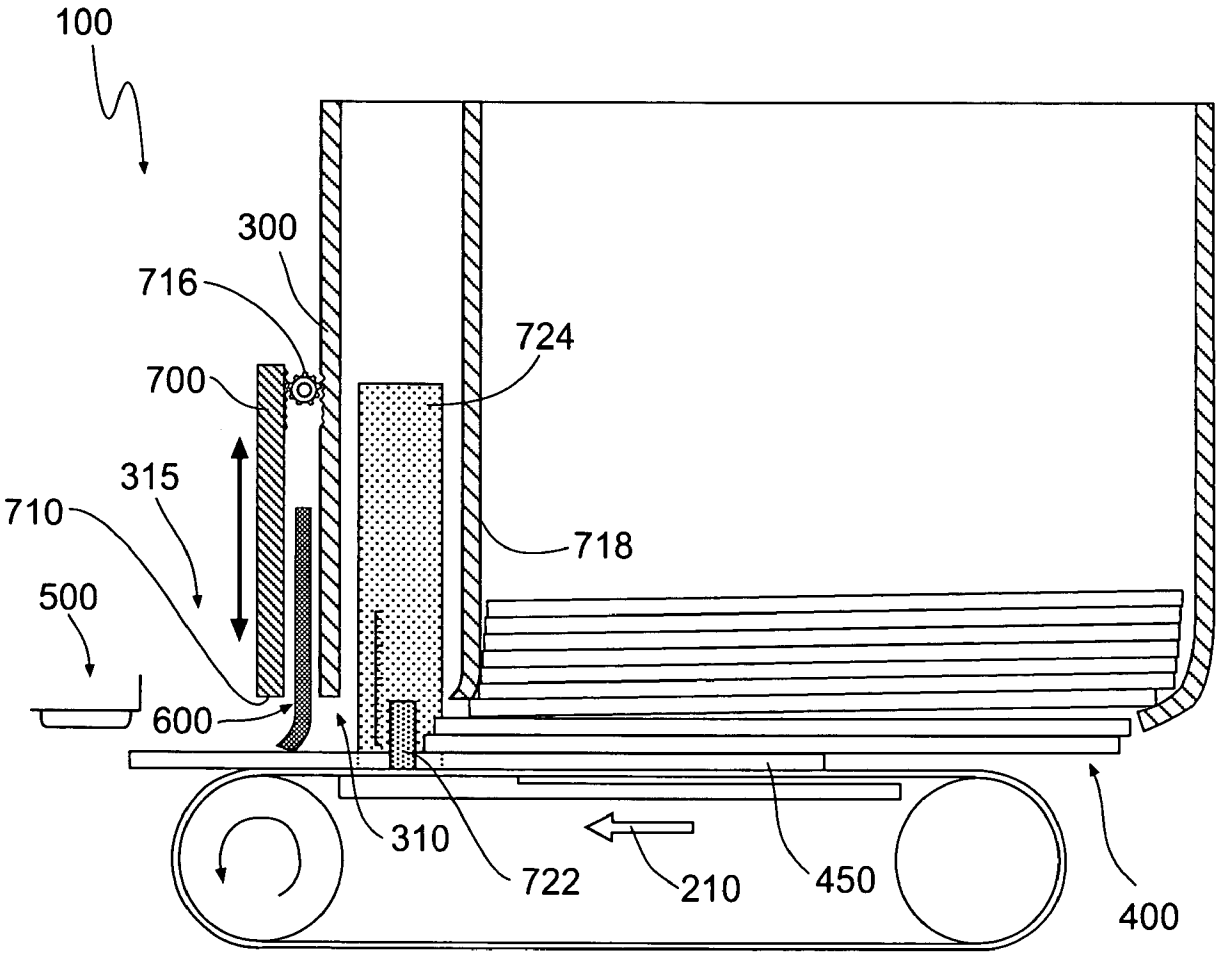

FIG. 5D illustrates still another embodiment of the present invention illustrating an automated device for adjusting the position of the adjusting member 700. In this embodiment, a "story board" 722 or the like is placed in the feeder device 100 on one lateral side of the card 450. Laterally opposite the story board 722 is a sensor 724. In this embodiment, the card 450 is thus positioned between the laterally-separated sensor 724 and story board 722. The sensor 722 determines how much of the story board 722 is hidden by the card 450 to thereby determine the thickness of the card 450 and, in turn, feeds the thickness measurement to a processor (not shown) that uses a stepper motor (not shown) to adjust the disposition of the operative portion 710 of the adjusting member 700. Again, in this embodiment, any number of sensor systems may be employed to determine the thickness of the card 450 as previously discussed and as will be appreciated by one skilled in the art.

Various views of a feeder device 100 according to one particular embodiment of the present invention are shown in FIGS. 6A, 6B, 7A-7F, and 8A-8D illustrating relative dispositions and interactions of the various elements of and interacting with the feeder device 100 described herein, such as the end card 450, the biased member 712, the drive mechanism 200, the blade member 600, the adjusting member 700, the gate apparatus 300, and the stack of cards 400. Such elements are not further described here, having already been described elsewhere herein in significant detail.

Many modifications and other embodiments of the inventions set forth herein will come to mind to one skilled in the art to which these inventions pertain having the benefit of the teachings presented in the foregoing descriptions and the associated drawings. For example, the adjustably flexible feed gate apparatus described herein may be advantageously combined with a feeder device 100 having aspects directed to improving conditions under which cards are fed to the print engine 500. Such aspects of the feeder device 100 are described in, for example, U.S. patent application No. 10/837,903, entitled "FEEDER DEVICE HAVING INCREASED MEDIA CAPACITY AND MULTIPLE MEDIA THICKNESS FEED CAPABILITY AND ASSOCIATED METHOD," filed May 3, 2004. The referenced patent application discloses, for example, that the adjustably flexible feed gate apparatus described herein may be combined with a hopper configured to hold cards to be fed in such a manner as to reduce the sticking force acting on the end card 450, and to reduce the effect of the weight of the other cards in the stack 400 on the end card 450. Such a feeder device 100 may also include a mechanism between the hopper and the gate apparatus 300 configured to facilitate separation of the end card 450 from the stack 400, and to increase the driving force on the end card 450 by increasing contact with the drive mechanism. In other instances, the blade member 600 described herein may vary considerably in terms of, for example, the type and characteristics of the material comprising the blade member 600, the texture of the surfaces of the blade member 600, and/or the shape or configuration of the free end 620. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A feeder device for feeding a media unit from a stack of media units to a receiving apparatus, each media unit having a thickness, said feeder device comprising:

a drive mechanism adapted to drive a media unit from the stack of media units in a feed direction;

a gate apparatus defining an opening having a height and being aligned with the drive mechanism such that the drive mechanism feeds the driven media unit in the feed direction through the opening;

a flexible blade member fixedly engaged with the gate apparatus at a fixed end and cantilevered with respect to the gate apparatus so as to define a free end extending toward the drive mechanism, the blade member defining a length between the fixed end and the free end and extending from the fixed end so as to reduce the height of the opening, the blade member being further configured such that the flexibility thereof is adjustable, whereby the flexibility of the blade member is adjusted in correspondence with the thickness of the driven media unit being fed to the receiving apparatus; and a biased member disposed opposite the driven media unit from the drive mechanism and upstream of the blade member with respect to the feed direction, the biased member being configured to bias the driven media unit against the drive mechanism, as the driven media unit is fed therebetween in the feed direction, so as to separate the driven media unit from other media units within the stack and to increase a driving force on the driven media unit fed toward the blade member;

wherein the biased member and the flexibility of the blade member are linked such that the flexibility of the blade member adjusts in response to a displacement of the biased member.

2. A feeder device according to claim 1 further comprising a hopper configured to hold the stack of media units and capable of being operably engaged with the drive mechanism so as to allow the drive mechanism to feed the media unit in the drive direction.

3. A feeder device according to claim 1 further comprising an adjusting member operably engaged with the gate device downstream in the feed direction such that the blade member is disposed therebetween, the adjusting member being movable in relation to the blade member and configured to engage the blade member so as to vary the flexibility of the blade member in the feed direction.

4. A feeder device according to claim 1 further comprising an adjusting member operably engaged with the gate device downstream in the feed direction such that the blade member is disposed therebetween, the adjusting member being movable in substantially parallel relation to the gate device, along the length of the blade member toward and away from the fixed end, so as to vary the cantilevered length of the blade member, the varying cantilevered length thereby varying the flexibility of the blade member downstream in the feed direction and providing the adjustable flexibility thereof.

5. A feeder device for feeding a media unit from a stack of media units to a receiving apparatus, each media unit having a thickness, said feeder device comprising:

a drive mechanism adapted to drive a media unit from the stack of media units in a feed direction;

a gate apparatus defining an opening having a height and being aligned with the drive mechanism such that the drive mechanism feeds the driven media unit in the feed direction through the opening;

a flexible blade member fixedly engaged with the gate apparatus at a fixed end and cantilevered with respect to the gate apparatus so as to define a free end extending toward the drive mechanism, the blade member defining a length between the fixed end and the free end and extending from the fixed end so as to reduce the height of the opening, the blade member being further configured such that the flexibility thereof is adjustable, whereby the flexibility of the blade member is adjusted in correspondence with the thickness of the driven media unit being fed to the receiving apparatus; and a biased member disposed opposite the driven media unit from the drive mechanism and upstream of the blade member with respect to the feed direction, the biased member being configured to directly engage each driven media unit from the stack of media units in order to bias the driven media unit against the drive mechanism, as the driven media unit is fed therebetween in the feed direction, so as to separate the driven media unit from other media units within the stack and to increase a driving force on the driven media unit fed toward the blade member and;

an adjusting member opposing the gate device downstream in the feed direction and having the blade member disposed therebetween, the adjusting member being disposed medially with respect to the fixed and free ends of the blade member and movable in substantially perpendicular relation to the gate device, toward and away from the blade member, upstream and downstream with respect to the feed direction, respectively, so as to vary the flexibility of the blade member downstream in the feed direction and provide the adjustable flexibility thereof.

6. A feeder device according to claim 1, wherein the fixed end of the blade member comprises opposing ends of the blade member that are fixedly engaged with the gate device and wherein the free end of the blade member comprises a medial portion of the blade member that extends from a first edge toward a second edge of the opening, and the feeder device further comprises an adjusting member operably engaged with the gate device and movably engaged with the blade member between the opposed ends such that at least a portion of the adjusting member is at least partially surrounded by the opposing ends and medial portion of the blade member, the adjusting member being movable in substantially parallel relation to the gate device, toward and away from the medial portion of the blade member, so as to vary the flexibility of the blade member downstream in the feed direction and provide the adjustable flexibility thereof.

7. A feeder device according to claim 1, wherein the opening extends laterally between a first side and a second side so as to define a width, and the blade member contiguously extends at least partially across the width of the opening.

8. A feeder device according to claim 1, wherein the blade member defines a thickness between an upstream side and a downstream side thereof with respect to the feed direction, and the thickness of the blade member is substantially constant over the length of the blade member.

9. A feeder device according to claim 1, wherein the blade member is comprised of a thermoelastic material.

10. A feeder device according to claim 1, wherein the blade member defines a thickness between an upstream side and a downstream side thereof, with respect to the feed direction, and a hardness of the blade member varies in inverse relation to the thickness of the blade member.

11. A feeder device according to claim 1, wherein the blade member is configured to have a plurality of discrete flexibility levels, each flexibility level corresponding to a range of thicknesses of the media units fed by the feeder device.

12. A feeder device according to claim 1, wherein the drive mechanism comprises at least one of a transport belt and a drive roller.

13. A feeder device according to claim 1 further comprising a sensor for sensing the thickness of the media unit, the sensor being operably engaged with the blade member such that the flexibility of the blade member is capable of being varied relative to the thickness of the media unit as sensed by and in response to the sensor.

14. A feeder device according to claim 1 wherein the biased member is further configured to be capable of contacting at least an upper surface of the driven media unit so as to be displaced from the drive mechanism by a distance corresponding to the thickness of the driven media unit, and the feeder device further comprises:

an adjusting member operably engaged with the gate device downstream in the feed direction such that the blade member is disposed therebetween, the adjusting member being movable in relation to the blade member and configured to engage the blade member so as to vary the flexibility of the blade member in the feed direction;

a sensor in communication with the biased member for sensing the displacement distance of the biased member in response to the thickness of the driven media unit; and a processor in communication with the sensor and the adjusting member, the processor being configured to direct adjustment of the adjusting member in response to the sensor so as to adjust the flexibility of the blade member with respect to the thickness of the driven media unit.

15. A feeder device according to claim 1 further comprising:

an adjusting member operably engaged with the gate device downstream in the feed direction such that the blade member is disposed therebetween, the adjusting member being movable in relation to the blade member and configured to engage the blade member so as to vary the flexibility of the blade member in the feed direction;

a sensor configured to sense the thickness of the driven media unit; and a processor in communication with the sensor and the adjusting member, the processor being configured to be capable of directing adjustment of the adjusting member in response to the sensor so as to adjust the flexibility of the blade member with respect to the thickness of the driven media unit.

16. A feeder device according to claim 1 wherein the biased member is further configured to be capable of contacting at least an upper surface of the driven media unit so as to be displaced from the drive mechanism by a distance corresponding to the thickness of the driven media unit, and the feeder device further comprises:

an adjusting member operably engaged with the gate device downstream in the feed direction such that the blade member is disposed therebetween, the adjusting member being movable in relation to the blade member and configured to engage the blade member so as to vary the flexibility of the blade member in the feed direction; and a linkage operably engaged between the adjusting member and the biased member, the linkage being configured such that the displacement of the biased member in response to the thickness of the driven media unit correspondingly moves the adjusting member with respect to the blade member so as to vary the flexibility of the blade member.

17. A method of feeding a media unit from a stack of media units to a receiving apparatus with a feeder device comprising a drive mechanism, a biased member, a gate apparatus, and a flexible blade member, each media unit having a thickness, said method comprising:

driving a media unit from the stack of media units in a feed direction with the drive mechanism, through an opening defined by the gate apparatus and aligned with the drive mechanism;

adjusting the flexibility of the blade member, the blade member being fixedly engaged with the gate apparatus at a fixed end and cantilevered with respect to the gate apparatus so as to define a free end extending toward the drive mechanism, the blade member defining a length between the fixed end and the free end and extending from the fixed end so as to reduce the height of the opening, in correspondence with the thickness of the driven media unit being fed to the receiving apparatus;

biasing the driven media unit against the drive mechanism with a biased member disposed opposite the driven media unit from the drive mechanism and upstream of the blade member with respect to the feed direction, as the driven media unit is fed therebetween in the feed direction, so as to separate the driven media unit from other media units within the stack and to increase a driving force on the driven media unit fed toward the blade member and linking the flexibility of the blade member with the biased member such that the flexibility of the blade member adjusts in response to a displacement of the biased member.

18. A method according to claim 17, wherein the feeder device further comprises an adjusting member operably engaged with the gate device downstream in the feed direction such that the blade member is disposed therebetween, and the method further comprises moving the adjusting member in relation to the blade member so as to engage the blade member and thereby vary the flexibility of the blade member in the feed direction.

19. A method according to claim 17, wherein the feeder device further comprises an adjusting member operably engaged with the gate device downstream in the feed direction such that the blade member is disposed therebetween, and the method further comprises moving the adjusting member in substantially parallel relation to the gate device, along the length of the blade member toward and away from the fixed end, so as to vary the cantilevered length of the blade member and thereby vary the flexibility of the blade member downstream in the feed direction.

20. A method of feeding a media unit from a stack of media units to a receiving apparatus with a feeder device comprising a drive mechanism, a biased member, a gate apparatus, and a flexible blade member, each media unit having a thickness, said method comprising:

driving a media unit from the stack of media units in a feed direction with the drive mechanism, through an opening defined by the gate apparatus and aligned with the drive mechanism;

adjusting the flexibility of the blade member, the blade member being fixedly engaged with the gate apparatus at a fixed end and cantilevered with respect to the gate apparatus so as to define a free end extending toward the drive mechanism, the blade member defining a length between the fixed end and the free end and extending from the fixed end so as to reduce the height of the opening, in correspondence with the thickness of the driven media unit being fed to the receiving apparatus; and biasing the driven media unit against the drive mechanism with a biased member, the biased member being configured to directly engage each driven media unit from the stack of media units, and the biased member being disposed opposite the driven media unit from the drive mechanism and upstream of the blade member with respect to the feed direction, as the driven media unit is fed therebetween in the feed direction, so as to separate the driven media unit from other media units within the stack and to increase a driving force on the driven media unit fed toward the blade member and wherein the feeder device further comprises an adjusting member opposing the gate device downstream in the feed direction and having the blade member disposed therebetween, the adjusting member being disposed medially with respect to the fixed and free ends of the blade member, and the method further comprises moving the adjusting member in substantially perpendicular relation to the gate device, toward and away from the blade member, upstream and downstream with respect to the feed direction, respectively, so as to vary the flexibility of the blade member downstream in the feed direction.

21. A method according to claim 17, wherein the fixed end of the blade member comprises opposing ends of the blade member that are fixedly engaged with the gate device and wherein the free end of the blade member comprises a medial portion of the blade member that extends from a first edge toward a second edge of the opening, and the feeder device further comprises an adjusting member operably engaged with the gate device and slidably engaged with the blade member between the opposed ends such that at least a portion of the adjusting member is at least partially surrounded by the opposing ends and medial portion of the blade member, wherein the method further comprises moving the adjusting member in substantially parallel relation to the gate device, between the opposed ends and toward and away from the free end of the blade member, so as to vary the flexibility of the blade member downstream in the feed direction.

22. A method of feeding a media unit from a stack of media units to a receiving apparatus with a feeder device comprising a drive mechanism, a biased member, a gate apparatus, and a flexible blade member, each media unit having a thickness, said method comprising:

driving a media unit from the stack of media units in a feed direction with the drive mechanism, through an opening defined by the gate apparatus and aligned with the drive mechanism;

adjusting the flexibility of the blade member, the blade member being fixedly engaged with the gate apparatus at a fixed end and cantilevered with respect to the gate apparatus so as to define a free end extending toward the drive mechanism, the blade member defining a length between the fixed end and the free end and extending from the fixed end so as to reduce the height of the opening, in correspondence with the thickness of the driven media unit being fed to the receiving apparatus; and biasing the driven media unit against the drive mechanism with a biased member, the biased member being configured to directly engage each driven media unit from the stack of media units, and the biased member being disposed opposite the driven media unit from the drive mechanism and upstream of the blade member with respect to the feed direction, as the driven media unit is fed therebetween in the feed direction, so as to separate the driven media unit from other media units within the stack and to increase a driving force on the driven media unit fed toward the blade member and further comprising adjusting the flexibility of the blade member among a plurality of discrete flexibility levels, each flexibility level corresponding to a range of thicknesses of the media units fed by the feeder device.

23. A method according to claim 17 further comprising sensing the thickness of the driven media unit, and correspondingly varying the flexibility of the blade member in response thereto.

24. A method according to claim 17, wherein the feeder device further comprises an adjusting member operably engaged with the gate device downstream in the feed direction such that the blade member is disposed therebetween, the adjusting member being movable in relation to the blade member and configured to engage the blade member so as to vary the flexibility of the blade member in the feed direction; and wherein the biased member is configured to contact at least an upper surface of the driven media unit so as to be displaced from the drive mechanism by a distance corresponding to the thickness of the driven media unit; and the method further comprises:

sensing the displacement distance of the biased member in response to the thickness of the driven media unit; and directing adjustment of the adjusting member in response to the sensed displacement distance so as to adjust the flexibility of the blade member with respect to the thickness of the driven media unit.

25. A method according to claim 17, wherein the feeder device further comprises an adjusting member operably engaged with the gate device downstream in the feed direction such that the blade member is disposed therebetween, the adjusting member being movable in relation to the blade member and configured to engage the blade member so as to vary the flexibility of the blade member in the feed direction, and the method further comprises:

sensing the thickness of the driven media unit; and directing adjustment of the adjusting member in response to the sensed thickness of the driven media unit so as to adjust the flexibility of the blade member with respect to the thickness of the driven media unit.

26. A method according to claim 17, wherein the feeder device further comprises an adjusting member operably engaged with the gate device downstream in the feed direction such that the blade member is disposed therebetween, the adjusting member being movable in relation to the blade member and configured to engage the blade member so as to vary the flexibility of the blade member in the feed direction; wherein the biased member is configured to contact at least an upper surface of the driven media unit so as to be displaced from the drive mechanism by a distance corresponding to the thickness of the driven media unit; and wherein a linkage is operably engaged between the adjusting member and the biased member; and the method further comprises:

adjusting the adjusting member with respect to the blade member, in correspondence with the displacement of the biased member in response to the thickness of the driven media unit, via the linkage, so as to vary the flexibility of the blade member.

* * * * *